US010559891B2

(12) United States Patent
Biancotto et al.

(10) Patent No.: US 10,559,891 B2
(45) Date of Patent: Feb. 11, 2020

(54) FLAT PANEL ARRAY ANTENNA WITH INTEGRATED POLARIZATION ROTATOR

(71) Applicant: CommScope Technologies LLC, Hickory, NC (US)

(72) Inventors: Claudio Biancotto, Edinburgh (GB); Ian T. Renilson, Fife (GB); David J. Walker, Edinburgh (GB); Ronald J. Brandau, Homer Glen, IL (US)

(73) Assignee: CommScope Technologies LLC, Hickory, NC (US)

( * ) Notice: Subject to any disclaimer, the term of this patent is extended or adjusted under 35 U.S.C. 154(b) by 112 days.

(21) Appl. No.: 15/458,732

(22) Filed: Mar. 14, 2017

(65) Prior Publication Data

US 2017/0271776 A1 Sep. 21, 2017

Related U.S. Application Data

(60) Provisional application No. 62/308,436, filed on Mar. 15, 2016.

(51) Int. Cl.

| | |
|---|---|
| ***H01Q 21/06*** | (2006.01) |
| ***H01Q 21/24*** | (2006.01) |
| ***H01P 1/165*** | (2006.01) |

(52) U.S. Cl.

CPC ..... *H01Q 21/245* (2013.01); *H01P 1/165* (2013.01); *H01Q 21/064* (2013.01)

(58) Field of Classification Search

CPC ..... H01Q 21/0006; H01Q 21/0043; H01Q 21/005; H01Q 21/06; H01Q 21/061;

(Continued)

(56) References Cited

U.S. PATENT DOCUMENTS 4,757,324 A * 7/1988 Dhanjal ..... H01Q 13/02 343/772

4,959,658 A 9/1990 Collins (Continued)

FOREIGN PATENT DOCUMENTS

KR 10-2013-0054142 A 5/2013
WO 2009/031794 A1 3/2009

OTHER PUBLICATIONS

Notification of Transmittal of the International Search Report and the Written Opinion of the International Searching Authority, or the Declaration, International Application No. PCT/GB2017/022297, dated Jun. 7, 2017, 14 pages.

(Continued)

*Primary Examiner* — Daniel Munoz
*Assistant Examiner* — Patrick R Holecek
(74) *Attorney, Agent, or Firm* — Myers Bigel, P.A.

(57) ABSTRACT

A panel array antenna comprises an input layer including a waveguide network coupling an input feed on a first side thereof to a plurality of primary coupling cavities on a second side thereof, and an output layer on the second side of the input layer. The output layer includes an array of horn radiators, respective horn radiator inlet ports in communication with the horn radiators, and respective slot-shaped output ports in communication with the respective horn radiator inlet ports to couple the horn radiators to the primary coupling cavities. The horn radiators, the respective horn radiator inlet ports, and the respective slot-shaped output ports are integrated in a monolithic layer, which is configured to provide respective output signals from the horn radiators having a polarization orientation that is rotated by a desired polarization rotation angle relative to respective input signals received at the respective slot-shaped output ports coupled thereto.

28 Claims, 26 Drawing Sheets

(58) Field of Classification Search
CPC .... H01Q 21/064; H01Q 21/245; H01Q 21/29; H01Q 21/293
See application file for complete search history.

(56) References Cited

U.S. PATENT DOCUMENTS

| | | | | |
|---|---|---|---|---|
| 6,028,562 | A * | 2/2000 | Guler | H01Q 13/10 343/770 |
| 6,501,434 | B1 | 12/2002 | Hollenstein et al. | |
| 8,558,746 | B2 | 10/2013 | Thomson et al. | |
| 2010/0231475 | A1 | 9/2010 | Ou et al. | |
| 2013/0120205 | A1 | 5/2013 | Thomson et al. | |
| 2013/0120206 | A1* | 5/2013 | Biancotto | H01Q 21/005 343/776 |
| 2014/0254976 | A1* | 9/2014 | Thomson | H01P 1/173 385/11 |

OTHER PUBLICATIONS

Extended European Search Report corresponding to European Application No. 17767333.2 (dated Sep. 30, 2019).

* cited by examiner

INPUT POLARISATION
(SQUARE - 0deg)

OUTPUT POLARISATION
(DIAMOND - 45deg)

INPUT POLARISATION
(SQUARE -0deg)

OUTPUT POLARISATION
(DIAMOND - 45deg)

FLAT PANEL ARRAY ANTENNA WITH INTEGRATED POLARIZATION ROTATOR

CLAIM OF PRIORITY

This application claims priority from U.S. Provisional Patent Application No. 62/308,436 filed Mar. 15, 2016, the disclosure of which is incorporated by reference herein in its entirety.

FIELD

The present invention relates generally to communications systems and, more particularly, to flat panel array antennas utilized in cellular communications systems.

BACKGROUND

Flat panel array antenna technology may not be extensively used in the licensed commercial microwave point-to-point or point-to-multipoint market, where more stringent electromagnetic radiation envelope characteristics consistent with efficient spectrum management may be more common. Antenna solutions derived from traditional reflector antenna configurations, such as prime focus fed axisymmetric geometries, can provide high levels of antenna directivity and gain at relatively low cost. However, the extensive structure of a reflector dish and associated feed may require enhanced support structure to withstand wind loads, which may increase overall costs. Further, the increased size of reflector antenna assemblies and the support structure required may be viewed as a visual blight.

Array antennas typically utilize printed circuit technology or waveguide technology. The components of the array that interface with free-space, known as the elements, typically utilize microstrip geometries, such as patches, dipoles, and/or slots, or waveguide components such as horns and/or slots. The various elements may be interconnected by a feed network, so that the resulting electromagnetic radiation characteristics of the antenna can conform to desired characteristics, such as the antenna beam pointing direction, directivity, and/or sidelobe distribution.

Flat panel arrays may be formed, for example, using waveguide or printed slot arrays in resonant or travelling wave configurations. Resonant configurations typically cannot achieve the desired electromagnetic characteristics over the bandwidths utilized in the terrestrial point-to-point market sector, while travelling wave arrays typically provide a mainbeam radiation pattern which moves in angular position with frequency. Because terrestrial point-to-point communications generally operate with go/return channels spaced over different parts of the frequency band being utilized, movement of the mainbeam with respect to frequency may prevent simultaneous efficient alignment of the link for both channels.

Corporate fed waveguide or slot elements may be used in the design of fixed beam antennas to provide desired characteristics. However, it may be necessary to select an element spacing which is generally less than one wavelength, in order to avoid the generation of secondary beams known as grating lobes, which may not meet regulatory requirements, and/or may detract from the antenna efficiency. This close element spacing may conflict with the feed network dimensions. For example, in order to accommodate impedance matching and/or phase equalization, a larger element spacing may be required to provide sufficient volume to accommodate not only the feed network, but also sufficient material for electrical and mechanical wall contact between adjacent transmission lines (thereby isolating adjacent lines and preventing un-wanted interline coupling/cross-talk).

The elements of antenna arrays may be characterized by the array dimensions, such as a N×M element array where N and M are integers. In a typical N×M corporate fed array, (N×M)−1 T-type power dividers may be employed, along with N×M feed bends and multiple N×M stepped transitions in order to provide acceptable VSWR performance. Feed network requirements may thus be a limiting factor in space efficient corporate fed flat panel antenna arrays.

SUMMARY

According to some embodiments described herein, a panel array antenna includes an input layer comprising a waveguide network coupling an input feed on a first side thereof to a plurality of primary coupling cavities on a second side thereof, and an output layer on the second side of the input layer. The output layer may be a monolithic layer including an array of horn radiators, respective horn radiator inlet ports in communication with the horn radiators, and respective slot-shaped output ports in communication with the respective horn radiator inlet ports to couple the horn radiators to the primary coupling cavities. The monolithic layer is configured to provide respective output signals from the horn radiators having a polarization orientation that is rotated by a desired polarization rotation angle relative to respective input signals received at the respective slot-shaped output ports coupled thereto.

In some embodiments, the horn radiators, the respective horn radiator inlet ports, and the respective slot-shaped output ports coupled thereto of the monolithic layer may have respective shapes and/or orientations that are rotated relative to one another by at least a portion of the desired polarization rotation angle.

In some embodiments, the respective horn radiator inlet ports have respective longitudinal axes that may be rotated relative to those of the respective slot-shaped output ports coupled thereto by the at least a portion of the desired polarization rotation angle.

In some embodiments, the respective slot-shaped output ports may have elliptical-shaped end portions coupled by an elongated slot extending therebetween along the respective longitudinal axes thereof.

In some embodiments, each of the horn radiators may have a plurality of sidewalls that extend from a base including a corresponding one of the respective horn radiator inlet ports coupled thereto. The plurality of sidewalls may define a polygonal shape (for example, a square, hexagonal, or octagonal shape) around the corresponding one of the respective horn radiator inlet ports.

In some embodiments, the monolithic layer may further include respective polarization rotator elements in communication with the respective horn radiator inlet ports to couple the horn radiators to the respective slot-shaped output ports. The respective polarization rotator elements have respective longitudinal axes that may be rotated relative to those of the respective horn radiator inlet ports coupled thereto.

In some embodiments, the respective polarization rotator elements may be confined within edges of the respective horn radiator inlet ports coupled thereto in plan view.

In some embodiments, the respective polarization rotator elements are defined by respective multi-sided openings having one or more edges that may be aligned with one or more of the edges of the respective horn radiator inlet ports coupled thereto in plan view.

In some embodiments, the respective multi-sided openings may be confined within edges of and/or have respective longitudinal axes rotated relative to those of the respective slot-shaped output ports coupled thereto.

In some embodiments, the respective longitudinal axes of the respective multi-sided openings may be rotated relative to those of the respective slot-shaped output ports and/or the respective horn radiator inlet ports coupled thereto by a portion of a desired polarization rotation angle.

In some embodiments, each of the horn radiators may have a plurality of sidewalls that uniformly extend around a perimeter thereof from a base including one of the respective horn radiator inlet ports therein.

In some embodiments, the respective slot-shaped output ports, the respective horn radiator inlet ports, and/or the horn radiators may have radiused ends.

In some embodiments, the monolithic layer may include the horn radiators, the respective horn radiator inlet ports, and the respective slot-shaped output ports machined therein. In some embodiments, the monolithic layer may include the horn radiators, the respective horn radiator inlet ports, and the respective slot-shaped output ports formed therein by injection molding, die casting, and/or other techniques.

According to further embodiments described herein, a panel array antenna includes an input layer comprising a waveguide network coupling an input feed on a first side thereof to a plurality of primary coupling cavities on a second side thereof, and an output layer on the second side of the input layer. The output layer includes a plurality of elongated ports coupled to each of the primary coupling cavities by respective elongated slots between the elongated ports and each of the primary coupling cavities. The elongated ports and the respective elongated slots coupled thereto are integrated in a monolithic layer that is configured to rotate a polarization orientation of respective input signals received at the respective elongated slots.

In some embodiments, the respective elongated slots may have elliptical-shaped end portions along respective longitudinal axes that are rotated relative to those of the ports coupled thereto.

In some embodiments, the monolithic layer may further include respective diamond-shaped slots coupled between the elongated ports and the respective elongated slots coupled thereto. The respective diamond-shaped slots may include one or more edges that are aligned with the edges of the elongated ports coupled thereto in plan view.

In some embodiments, the elongated ports may be horn radiator inlet ports, and the monolithic layer may further include an array of horn radiators integrated in the monolithic layer on a second side thereof opposite the second side of the input layer. Each of the horn radiators may be coupled to a corresponding one of the respective elongated slots by one of the horn radiator inlet ports at a base thereof. Respective longitudinal axes of the horn radiator inlet ports may be rotated relative to those of the respective elongated slots coupled thereto by at least a portion of a desired polarization rotation angle.

According to yet further embodiments described herein, a method of manufacturing a panel array antenna includes providing an input layer including a waveguide network coupling an input feed on a first side thereof to a plurality of primary coupling cavities on a second side thereof, and providing an output layer on the second side of the input layer. The output layer may be a monolithic layer including an array of horn radiators, respective horn radiator inlet ports in communication with the horn radiators, and slot-shaped output ports in communication with the respective horn radiator inlet ports to couple the horn radiators to the primary coupling cavities. The monolithic layer is configured to provide respective output signals from the horn radiators having a polarization orientation that is rotated by a desired polarization rotation angle relative to respective input signals received at the respective slot-shaped output ports coupled thereto.

In some embodiments, providing the output layer may include forming the horn radiators, the respective horn radiator inlet ports, and the respective slot-shaped output ports coupled thereto in the monolithic layer to define respective shapes and/or orientations that are rotated relative to one another by at least a portion of the desired polarization rotation angle.

In some embodiments, forming the respective slot-shaped output ports may include forming elliptical-shaped end portions coupled by an elongated slot extending therebetween along the respective longitudinal axes thereof. The respective horn radiator inlet ports may be formed to define respective longitudinal axes thereof that are rotated relative to those of the respective slot-shaped output ports coupled thereto by the at least a portion of the desired polarization rotation angle.

In some embodiments, providing the output layer may include forming respective multi-sided openings in the output layer to define respective polarization rotator elements therein. The respective multi-sided openings may have respective longitudinal axes that are rotated relative to those of the respective horn radiator inlet ports coupled thereto.

In some embodiments, forming the horn radiators, the respective horn radiator inlet ports, and the respective slot-shaped output ports coupled thereto in the monolithic layer may include machining, injection molding, and/or die casting.

In some embodiments, the forming of the respective multi-sided openings may include machining the respective multi-sided openings in the output layer. The machining may be performed from a second side of the output layer through openings defined by the horn radiators and the respective ports therein such that the respective multi-sided openings are confined within edges of the respective ports coupled thereto in plan view.

In some embodiments, the respective longitudinal axes of the respective multi-sided openings may be rotated relative to those of the respective slot-shaped output ports coupled thereto.

In some embodiments, the machining of the respective multi-sided openings may be performed from a second side of the output layer through openings defined by the horn radiators and the respective ports therein, and/or may be performed from the first side of the output layer through openings defined by the respective slot-shaped output ports.

Other apparatus and/or methods according to some embodiments will become apparent to one with skill in the art upon review of the following drawings and detailed description. It is intended that all such additional embodiments, in addition to any and all combinations of the above embodiments, be included within this description, be within the scope of the invention, and be protected by the accompanying claims.

BRIEF DESCRIPTION OF THE DRAWINGS

The accompanying drawings, which are incorporated in and constitute a part of this specification, illustrate embodiments of the invention, where like reference numbers in the drawing figures refer to the same feature or element and may not be described in detail for every drawing figure in which they appear and, together with a general description of the invention given above, and the detailed description of the embodiments given below, serve to explain the principles of the invention.

DETAILED DESCRIPTION

Figure 1:
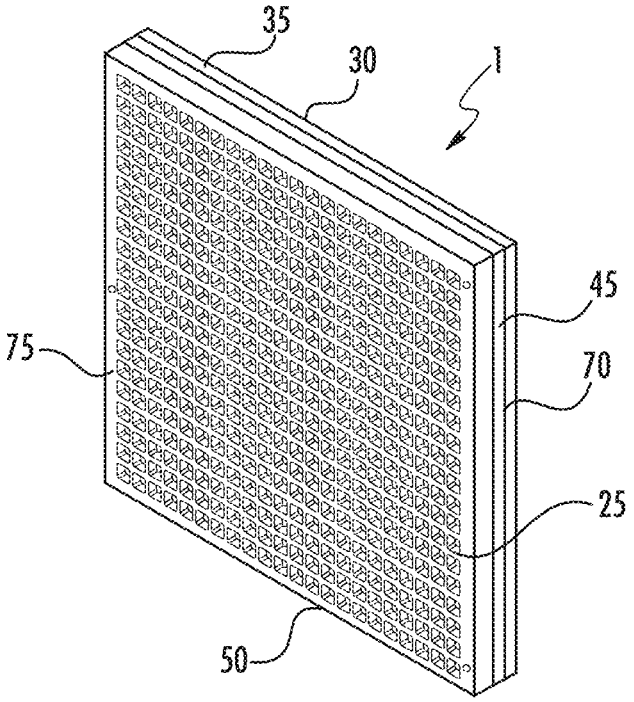
FIG. 1 is a schematic isometric angled front view of flat panel antenna in accordance with some embodiments.

Flat panel array antennas may be formed in multiple layers via machining or casting. For example, U.S. Pat. No. 8,558,746 to Thomson et al. (the disclosure of which is hereby incorporated by reference herein in its entirety) discusses a flat panel array antenna constructed as a series of different layers. Shown therein are flat panel arrays that include input, intermediate and output layers, with some embodiments including one or more slot layers and one or more additional intermediate layers. The layers are manufactured separately (typically via machining or casting) and stacked to form an overall feed network.

Some embodiments of the present invention provide apparatus and methods that allows for less complex fabrication of a flat panel antenna to provide electrical performance approaching that of much larger traditional reflector antennas, and which can meet stringent electrical specifications over the operating band used for a typical microwave communication link. In particular, embodiments of the present invention provide a flat panel antenna utilizing a corporate waveguide network and cavity couplers provided in stacked layers, and an output layer including cavity output ports horn radiator inlet ports, and horn radiators (and in some embodiments, polarization rotator elements) that are machined in a monolithic structure that is configured to provide a desired rotation of a polarization orientation that is input thereto.

In embodiments including polarization rotator elements integrated in a monolithic output layer, the polarization rotator elements may be sized such that dimensions thereof are confined within dimensions of horn radiator inlet ports at the base of the horn radiators and/or within dimensions of primary coupling cavity output ports that provide communication with the coupling cavities, such that the polarization rotator elements can be machined from either side of the output layer. For example, the polarization rotator components may include elongated, generally diamond-shaped openings (also referred to herein as slots or cavities) between the horn radiator inlet ports and the primary coupling cavity output ports, where one or more edges of the polarization rotator components follow the contours of and are confined within edges the horn radiator inlet ports or the primary coupling cavity output ports coupled thereto, when viewed in plan view.

In embodiments that do not include specific or dedicated polarization rotator elements in a monolithic output layer (also referred to herein as "rotatorless" designs), the dimensions of horn radiator inlet ports may be sized within dimensions of the horn radiators, such that the horn inlet ports can be machined from the horn radiator-side of the output layer. Also, the cavity output ports may have a double-ridge design, which can be machined from the output port-side of the output layer.

The machined ports or openings in the output layer may have radiused ends in some embodiments, but may have sharper corners in some further embodiments. The fabrication of multiple elements that are integrated in a single, unitary output layer, rather than as separate layers, can reduce fabrication time and/or tooling costs. Although described primarily herein with respect to machining processes to form the monolithic output layer, it will be understood that the monolithic output layer may be formed by injection molding, die casting, and/or other techniques in some embodiments.

It will be understood that, as described herein, various attributes of an antenna array, such as beam elevation angle, beam azimuth angle, and half power beam width, may be determined based on the magnitude and/or phase of the signal components that are fed to each of the radiating elements. The magnitude and/or phase of the signal components that are fed to each of the radiating elements may be adjusted so that the flat panel antenna will exhibit a desired antenna coverage pattern in terms of, for example, beam elevation angle, beam azimuth angle, and half power beam width. The desired frequency range of operation may determine the sizes, dimensions, and/or spacings of the elements of the antenna array. For example, element dimensions for operation above about 40 GHz may be too small for practical implementation from a manufacturing standpoint, while element dimensions for operation below about 15 GHz may be too bulky. As such, some antenna arrays described herein may operate in a frequency range of about 15 GHz up to about 40 GHz.

As shown in FIGS. 1-8, a flat panel array antenna 1 in accordance with some embodiments is formed from several layers, an input layer 35, an intermediate layer 45, and an output layer 75, each with surface contours and apertures combining to form a feed horn array and RF path including a series of enclosed coupling cavities and interconnecting waveguides when the layers are stacked upon one another.

The RF path includes a waveguide network 5 coupling an input feed 10 on a first side 30 of the intermediate layer 45 to a plurality of primary coupling cavities 15 on a second side 50 of the intermediate layer 45. Each of the primary coupling cavities 15 is coupled to four output ports 20, and each of the output ports 20 is coupled to a respective horn radiator 25. The low loss 4-way coupling of each cavity 15 can simplify the requirements of the corporate waveguide network, enabling higher feed horn density for improved electrical performance. The layered configuration may also allow for cost efficient precision in mass production.

Figure 26:
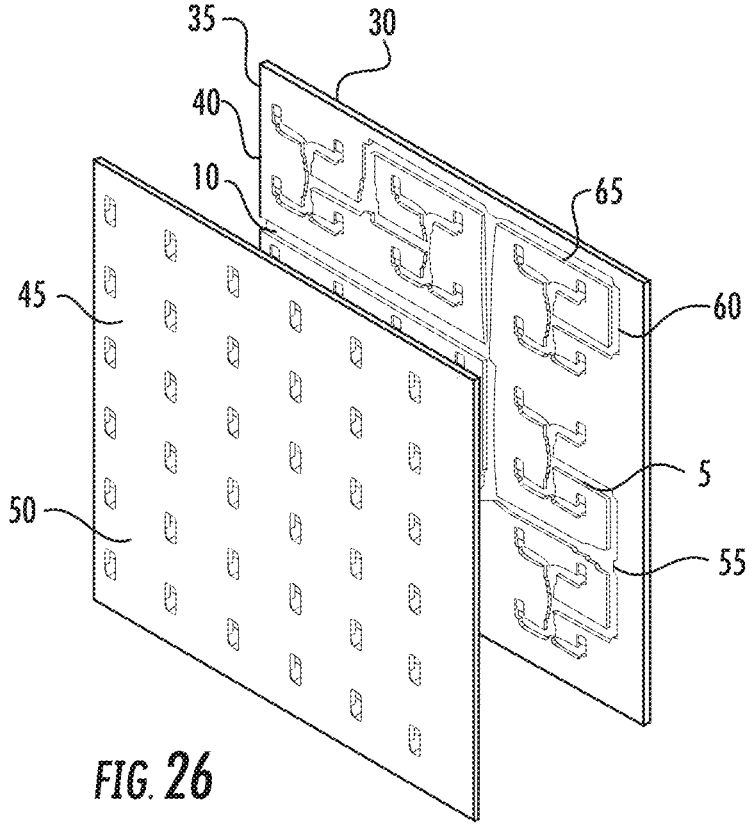
FIG. 26 is a schematic isometric view of an input layer and first intermediate layer demonstrating an E-plane waveguide network with an input feed at a layer sidewall in accordance with some embodiments.
Figure 27:
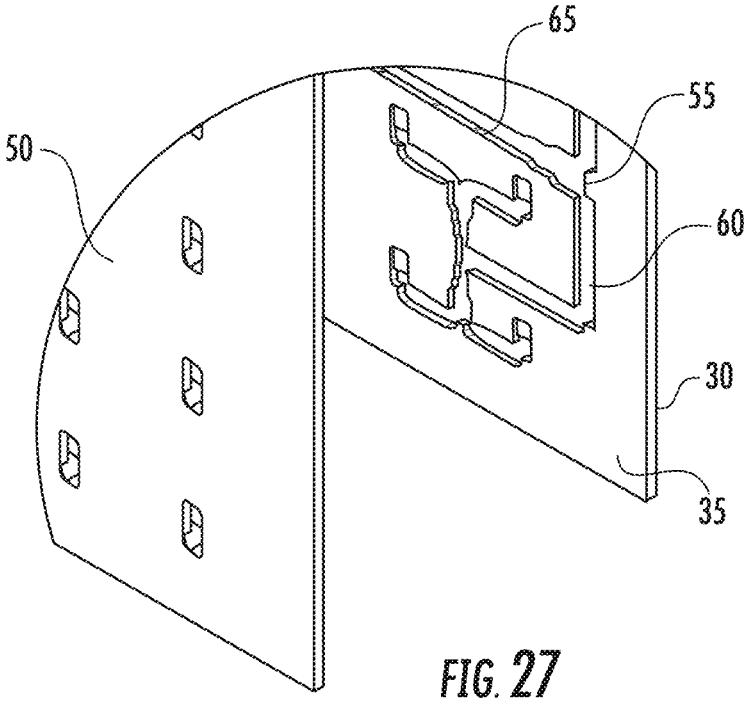
FIG. 27 is a close-up view of FIG. 26 in accordance with some embodiments.

The input feed 10 is demonstrated positioned in a generally central location on the first side 30 of the input layer 35, for example to allow compact mounting of a microwave transceiver thereto, using antenna mounting features (not shown) interchangeable with those used with traditional reflector antennas. Alternatively, the input feed 10 may be positioned at a layer sidewall 40, as shown for example in FIG. 26, between the input layer 35 and a first intermediate layer 45 enabling, for example, an antenna side by side with the transceiver configuration where the depth of the resulting flat panel antenna assembly is reduced or minimized.

Figure 3:
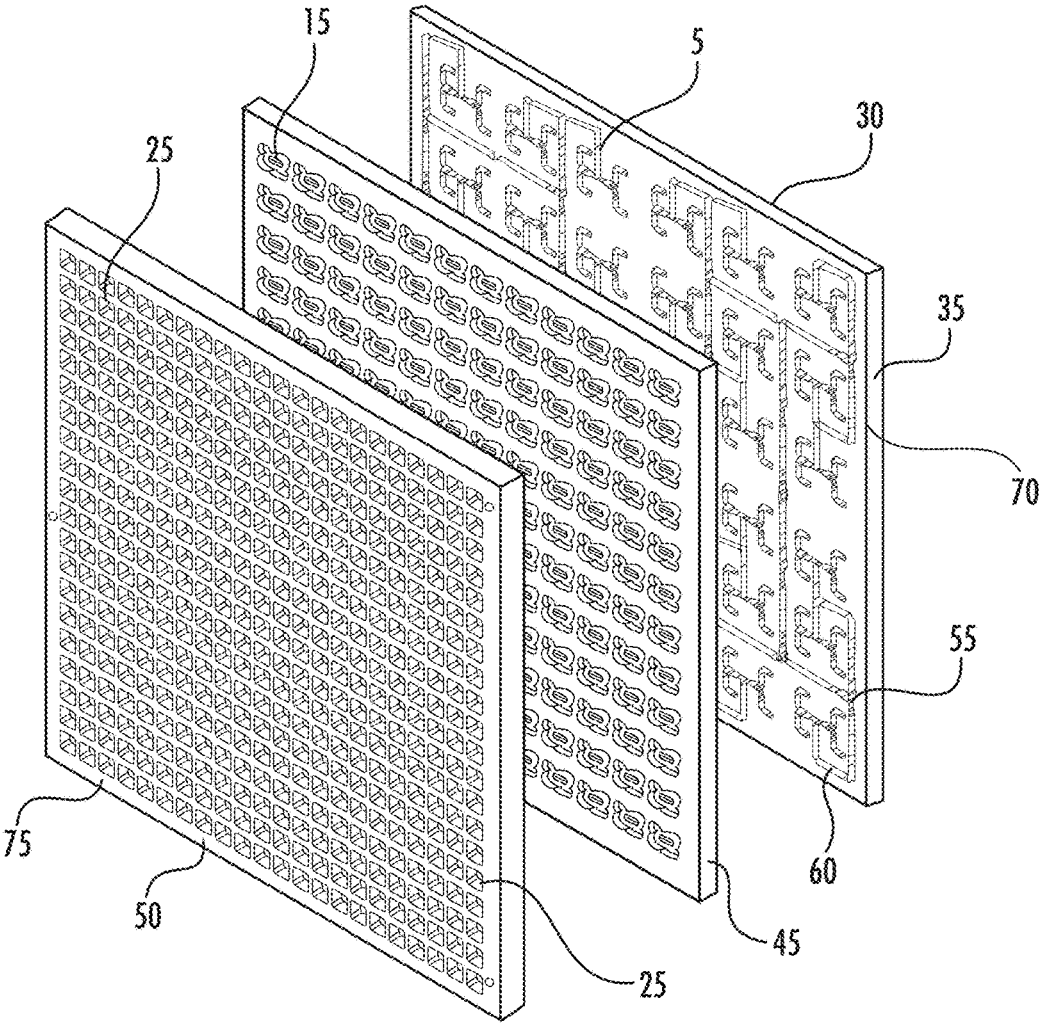
FIG. 3 is a schematic isometric exploded view of FIG. 1 in accordance with some embodiments.
Figure 4:
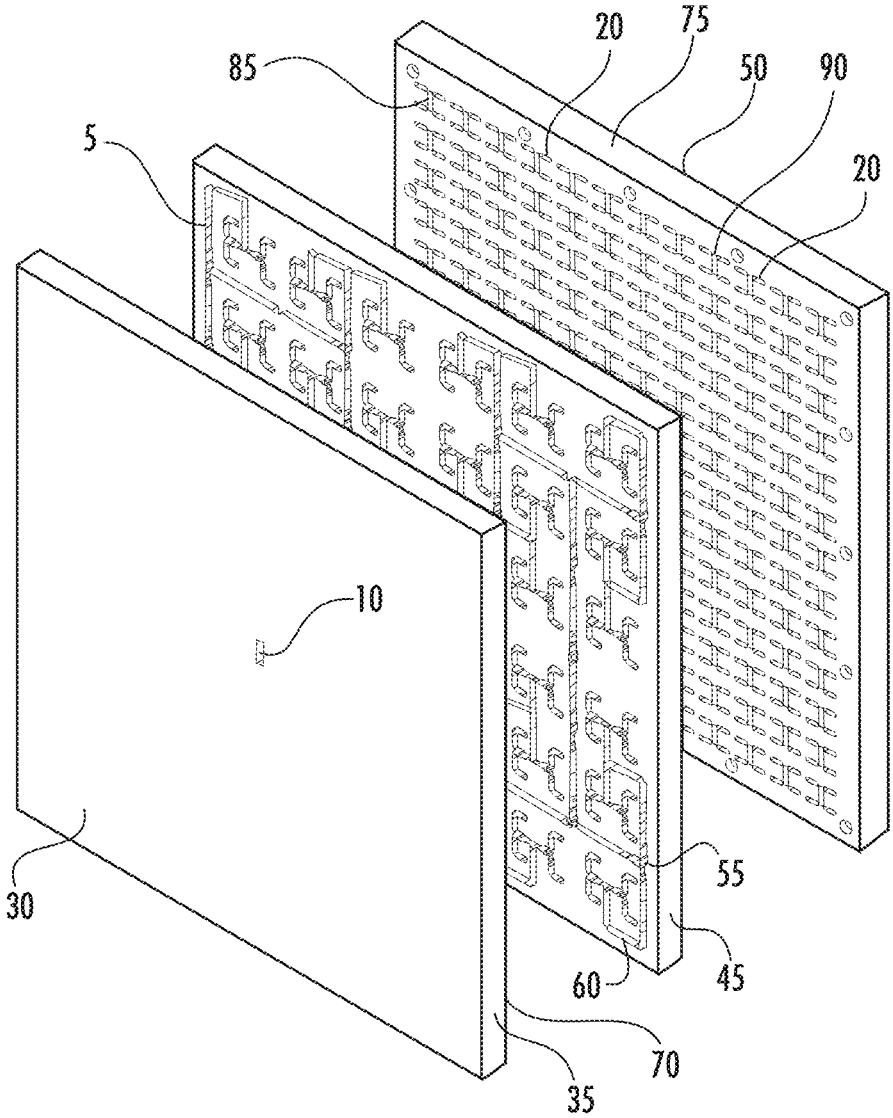
FIG. 4 is a schematic isometric exploded view of FIG. 2 in accordance with some embodiments.
Figure 5:
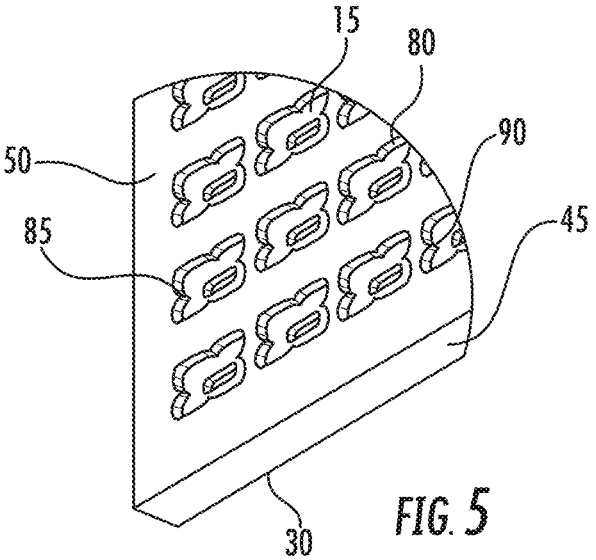
FIG. 5 is an enlarged view of the second side of the intermediate layer of FIG. 3 in accordance with some embodiments.
Figure 6:
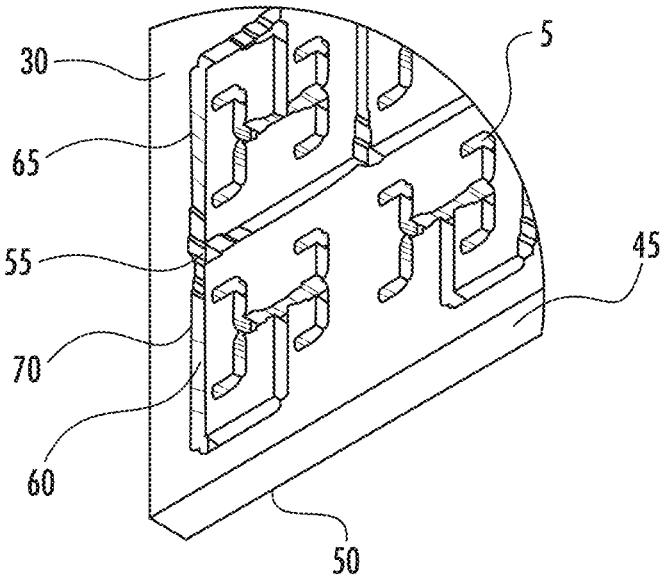
FIG. 6 is a close-up view of the first side of the intermediate layer of FIG. 3 in accordance with some embodiments.
Figure 7:
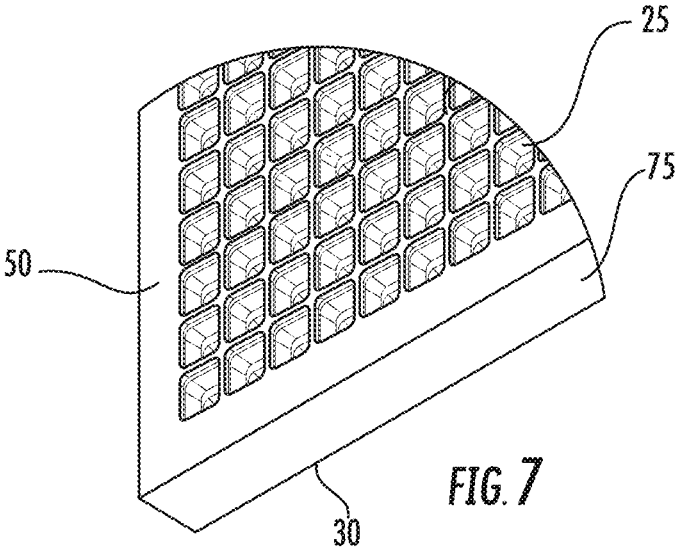
FIG. 7 is a close-up view of the second side of the output layer of FIG. 3 in accordance with some embodiments.
Figure 8:
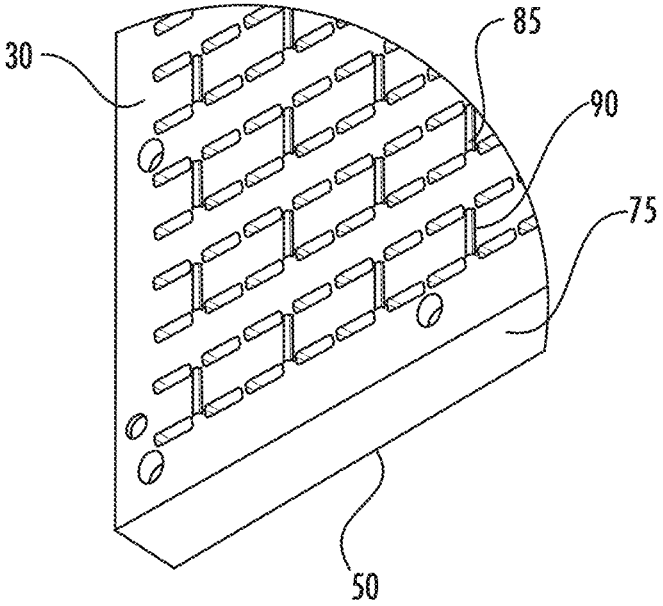
FIG. 8 is a close-up view of the first side of the output layer of FIG. 3 in accordance with some embodiments.

As shown in FIGS. 3, 4 and 6, the waveguide network 5 is provided by way of example on the second side 50 of the input layer 35 and the first side 30 of the intermediate layer 45. The waveguide network 5 distributes the RF signals to and from the input feed 10 to a plurality of primary coupling cavities 15 provided on a second side 50 of the intermediate layer 45. The waveguide network 5 may be dimensioned to provide an equivalent length electrical path to each primary coupling cavity 55 to ensure common phase and amplitude. T-type power dividers 55 may be applied to repeatedly divide the input feed 10 for routing to each of the primary coupling cavities 15. The waveguide sidewalls 60 of the waveguide network 5 may also be provided with surface features 65 for impedance matching, filters and/or attenuation.

Figure 9:
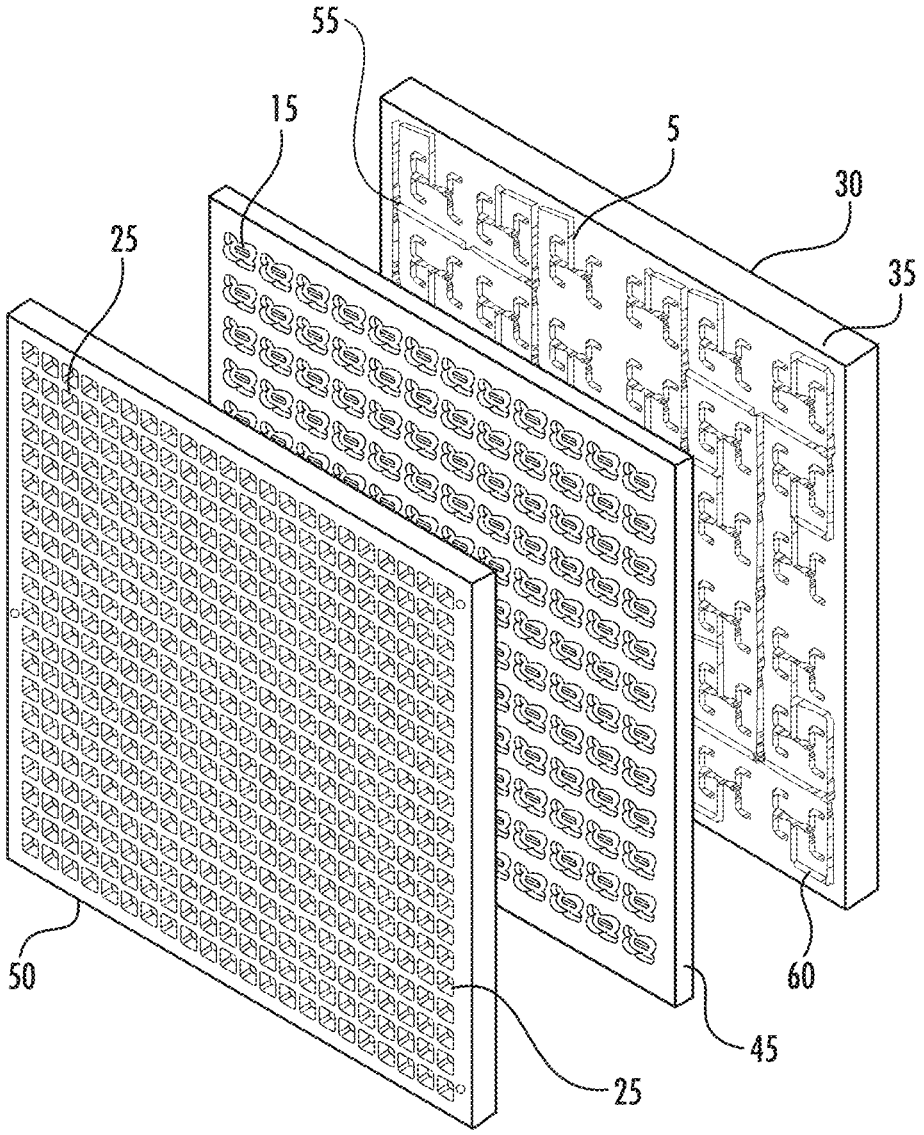
FIG. 9 is a schematic isometric angled front view of a waveguide network of a flat panel antenna in accordance with further embodiments.
Figure 10:
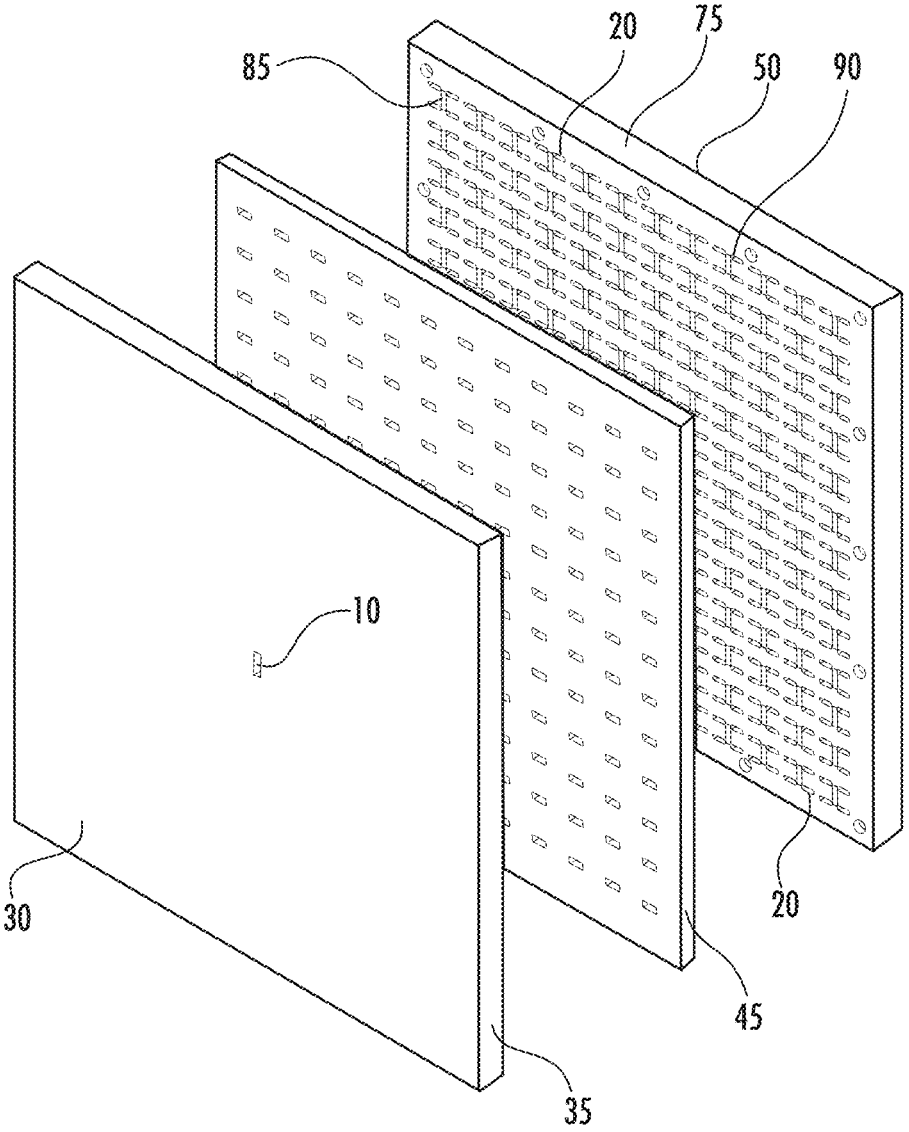
FIG. 10 is a schematic isometric angled back view of the flat panel antenna of FIG. 9 in accordance with further embodiments.

The waveguide network 5 may be provided with a rectangular waveguide cross-section, a long axis of the rectangular cross-section normal to a surface plane of the input layer 35, as shown for example in FIG. 6. Alternatively, the waveguide network 5 may be configured wherein a long axis of the rectangular cross-section is parallel to a surface plane of the input layer 35, as shown for example in FIG. 26. A seam 70 between the input layer 35 and the first intermediate layer 45 may be applied at a midpoint of the waveguide cross-section, as shown for example in FIGS. 3, 4, and 6. Thereby, leakage and/or dimensional imperfections appearing at the layer joint may be at a region of the waveguide cross-section where the signal intensity is reduced or minimized. Further, sidewall draft requirements for manufacture of the layers by injection molding mold separation may be reduced or minimized, as the depth of features formed in either side of the layers is halved. Alternatively, the waveguide network 5 may be formed on the second side 50 of the input layer 35 or the first side 30 of the first intermediate layer 45 with the waveguide features at full waveguide cross-section depth in one side or the other, and the opposite side operating as the top or bottom sidewall, closing the waveguide network 5 as the layers are seated upon one another, as shown in the examples of FIGS. 9 and 10.

Figure 22:
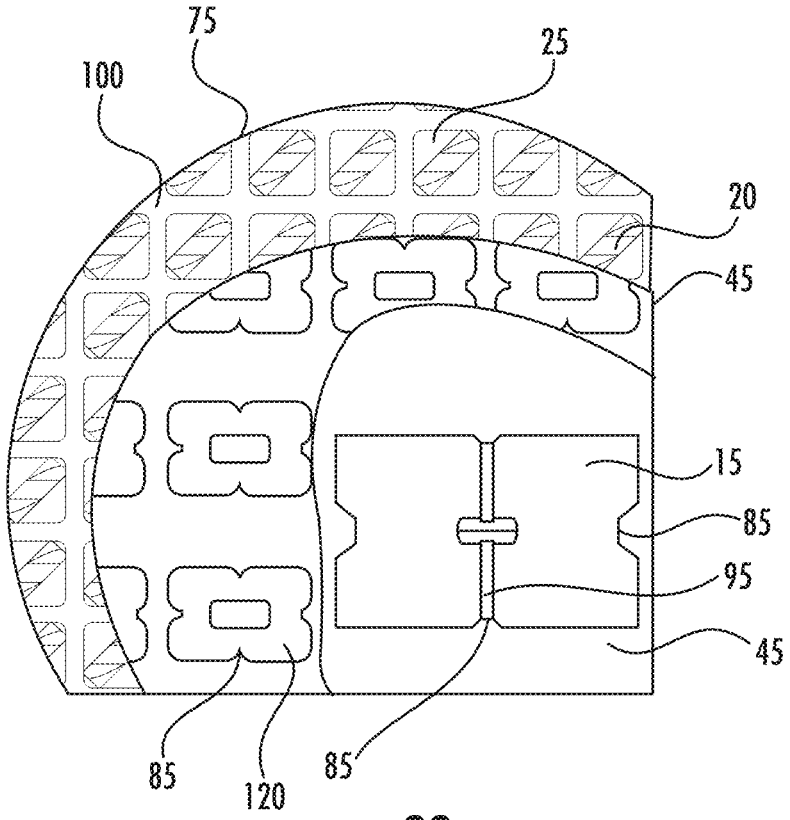
FIG. 22 is a close-up partial cut away front view of FIG. 18 in accordance with further embodiments.

The primary coupling cavities 15, each fed by at least one connection to the waveguide network 5; can provide, for example, −6 dB coupling to four output ports 20. The primary coupling cavities 15 may have a substantially rectangular configuration with the waveguide network connection/input port and the four output ports 20 on opposite sides of each coupling cavity 15. The output ports 20 are provided on the first side 30 of a unitary or monolithic output layer 75, each of the output ports 20 in communication with one of the horn radiators 25. The horn radiators 25 are provided as an array of horn radiators 25 on the second side 50 of the output layer 75. Dimensions of each horn radiator 25 may be less than a desired wavelength of operation. The sidewalls 80 of the primary coupling cavities 15 and/or the first side 30 of the output layer 75 may be provided with tuning features 85, such as septums 90 projecting into the substantially rectangular primary coupling cavities 15 and/or grooves 95 forming a depression to balance transfer between the waveguide network 5 and the output ports 20 of each primary coupling cavity 15. The tuning features 85 may be provided symmetrical with one another on opposing edges of the cavities 15, as shown in FIGS. 22-23, and/or spaced equidistant between the output ports 20.

Figure 23:
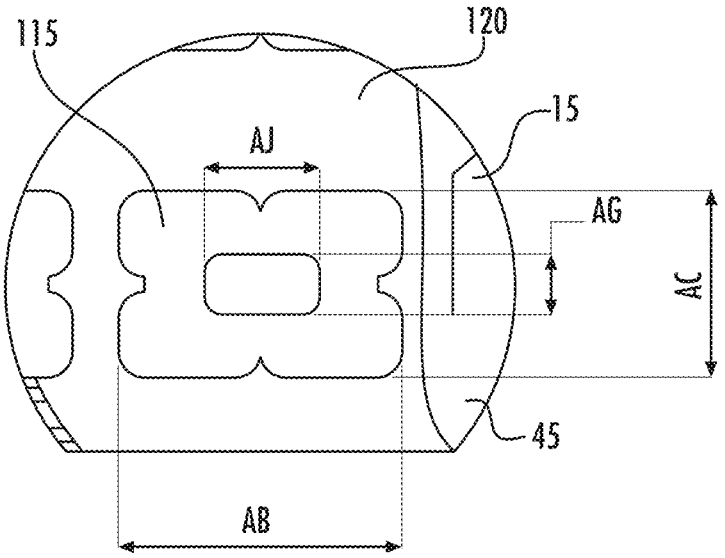
FIG. 23 is a close-up view of FIG. 22, with dimensional references for a coupling cavity in accordance with further embodiments.
Figure 24:
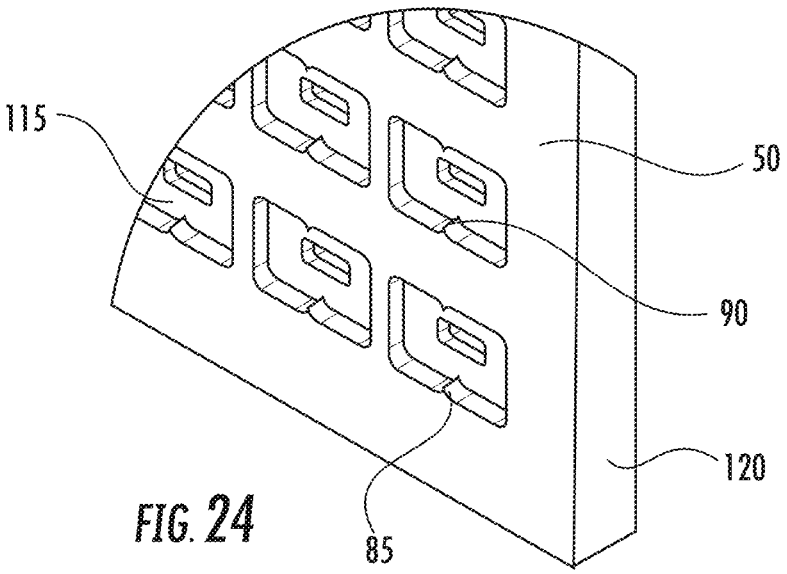
FIG. 24 is a schematic isometric close-up view of the second side of an alternative second intermediate layer in accordance with further embodiments.
Figure 25:
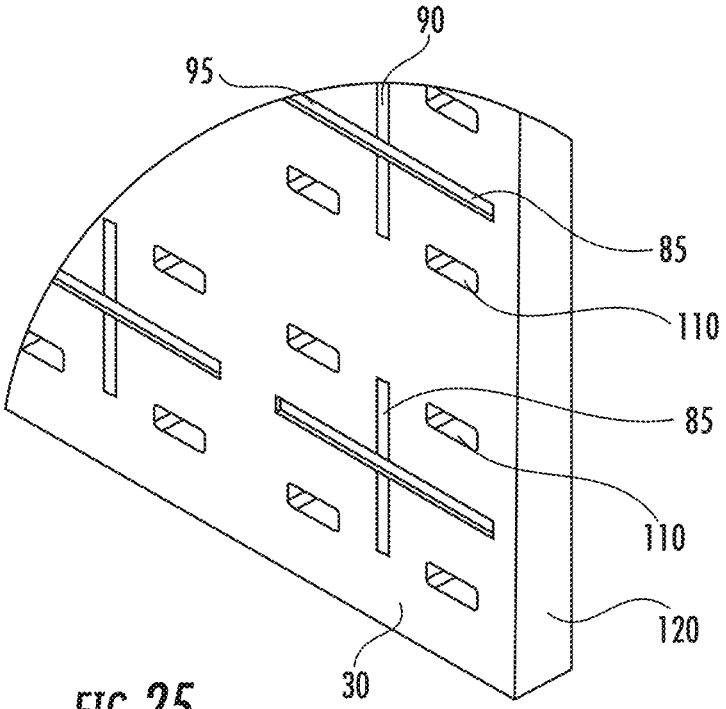
FIG. 25 is a schematic isometric close-up view of the first side of an alternative second intermediate layer in accordance with further embodiments.

To balance coupling between each of the output ports 20, each of the output ports 20 may be configured as rectangular slots that extend parallel to a long dimension of the rectangular cavity, AB, and the input waveguide, AJ, as shown in FIG. 23. Similarly, the short dimension of the rectangular output ports 20 may be aligned parallel to the short dimension of the cavity, AC, which extends parallel to the short dimension of the waveguide input ports, AG.

When using array element spacing of between 0.75 and 0.95 wavelengths to provide acceptable or desired array directivity, with sufficient defining structure between elements, a cavity aspect ratio, AB:AC may be, for example, 1.5:1. An example cavity 15 may be dimensioned with a depth less than 0.2 wavelengths, a width, AC, close to n× wavelengths, and a length, AB, close to n×3/2 wavelengths.

FIGS. 1-10 have been described above without discussion of a polarization orientation of the output signals relative to the polarization orientation as delivered to the input feed 10. In some embodiments, the output layer 75 may include integrated polarization rotator elements 100 between the first and second sides 30 and 50 thereof. The polarization rotator elements 100 may be defined as openings or cavities within a monolithic output layer 75, where the openings or cavities have longitudinal axes that are rotated relative to the longitudinal axes of horn radiator inlet ports 31 at the base of the horn radiators 25 and/or the longitudinal axes of the cavity output ports 20 to provide a desired polarization rotation angle between the polarization orientation input from the primary coupling cavities 15 and the polarization orientation output by the horn radiators 25. In other embodiments, the cavity output ports 20, horn radiator inlet ports 31, and horn radiators 25 of the output layer 75 may be oriented, shaped, and/or otherwise configured to provide a desired polarization rotation angle between the polarization orientation input from the primary coupling cavities 15 and the polarization orientation output by the horn radiators 25, without the use of specific or dedicated polarization rotator elements 100. That is, the respective shapes and/or relative orientations of the output ports 20, horn radiator inlet ports 31, and/or horn radiators 25 themselves may provide the polarization rotation functionality in some embodiments.

Figure 11:
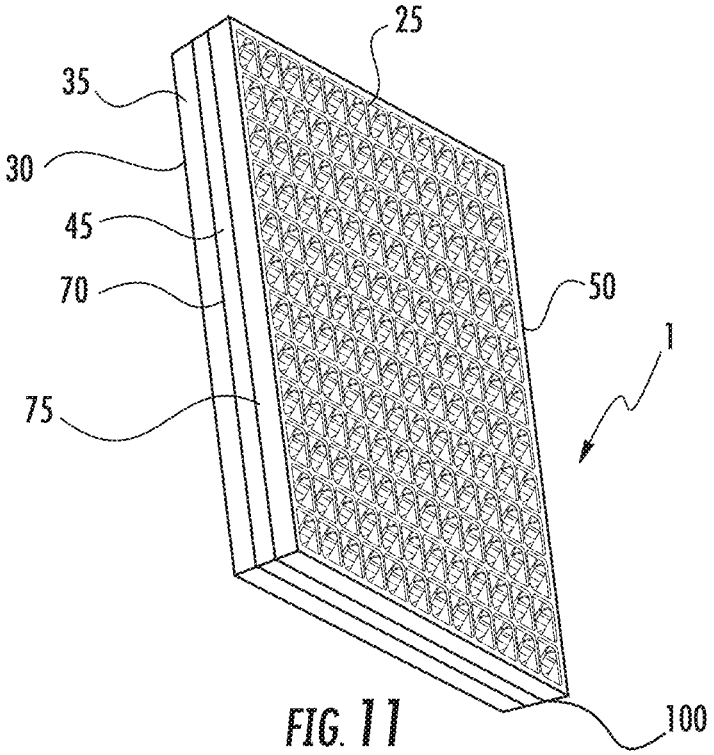
FIG. 11 is a schematic isometric angled front view of a flat panel antenna including integrated polarization rotator elements in accordance with some embodiments.
Figure 12:
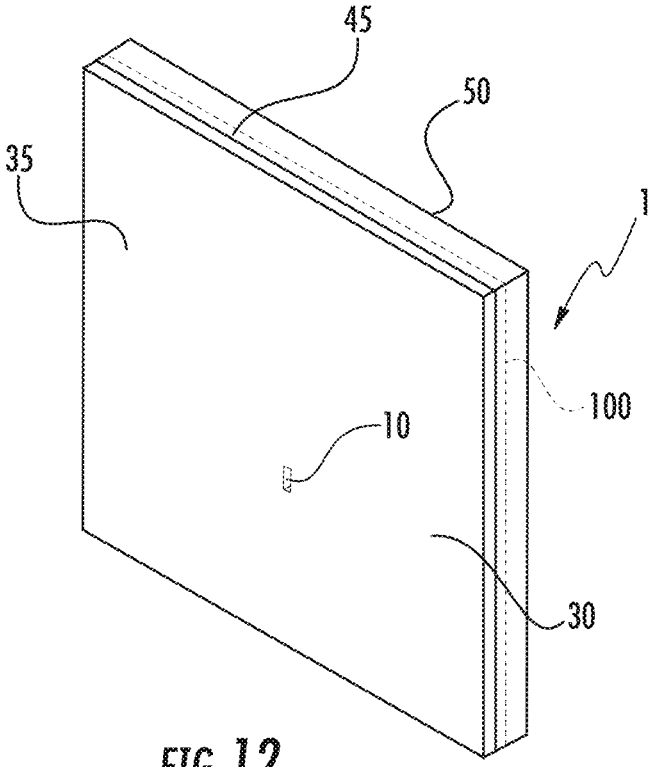
FIG. 12 is a schematic isometric angled back view of the flat panel antenna of FIG. 11 including integrated polarization rotator elements in accordance with some embodiments.
Figure 13:
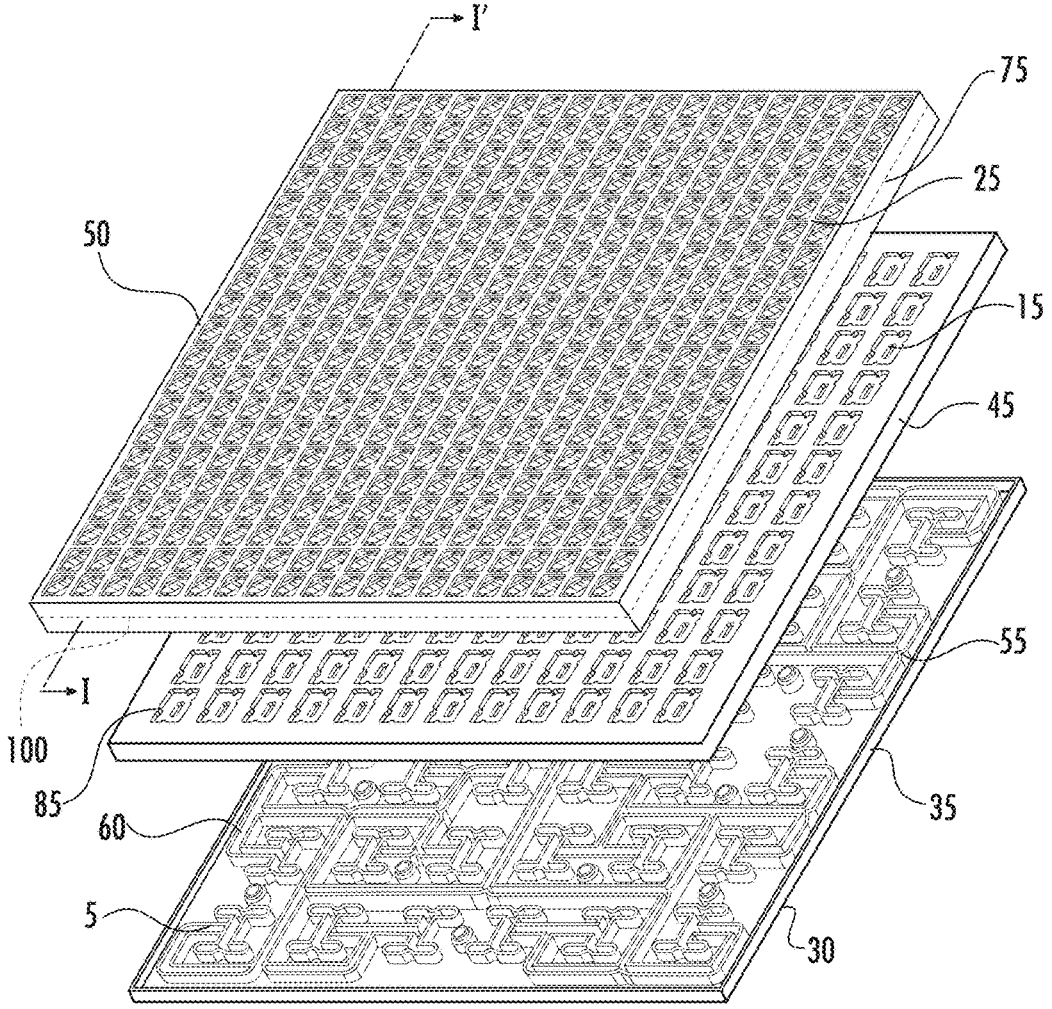
FIG. 13 is a schematic isometric exploded view of FIG. 11 in accordance with some embodiments.
Figure 14:
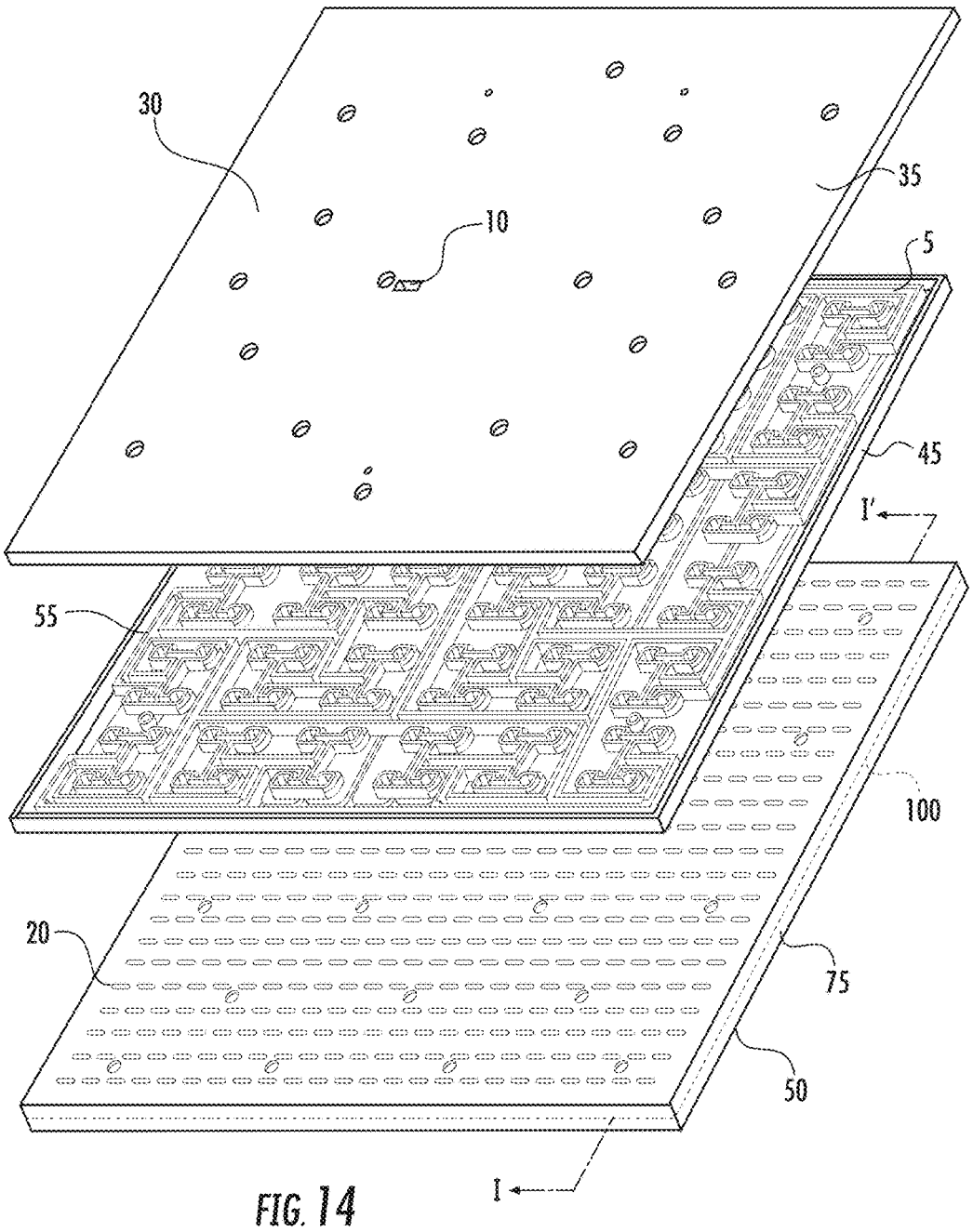
FIG. 14 is a schematic isometric exploded view of FIG. 12 in accordance with some embodiments.
Figure 15:
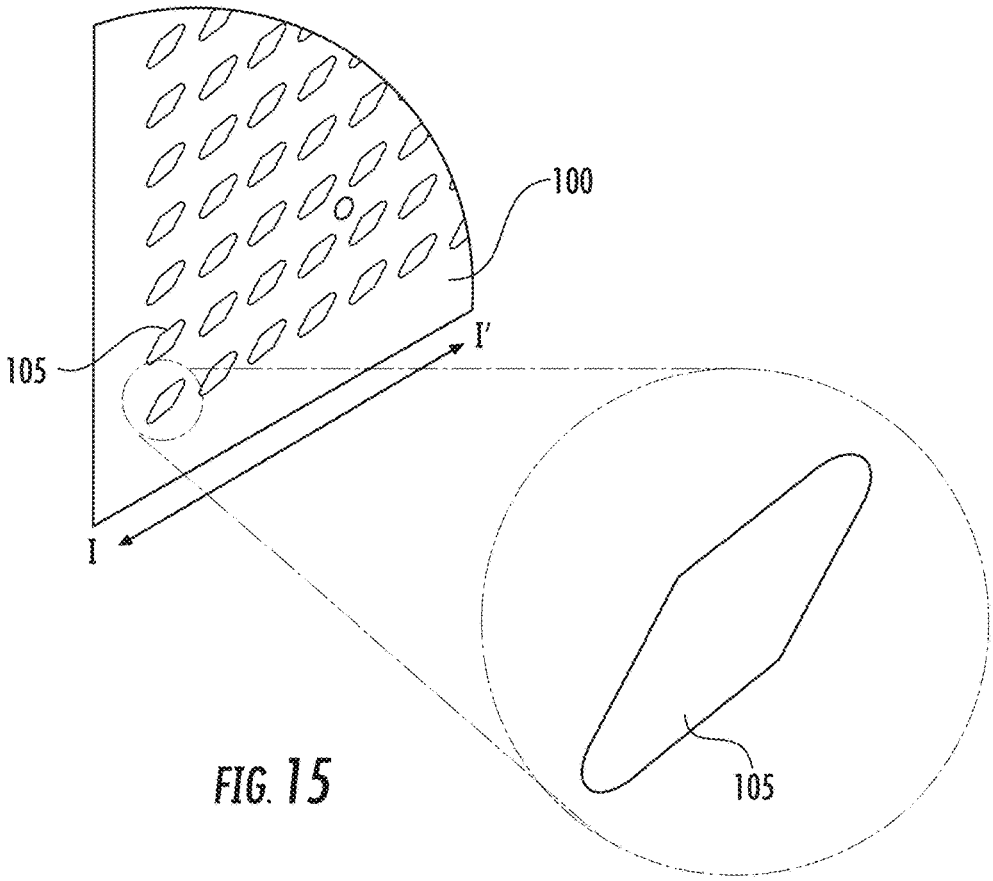
FIG. 15 is a close-up view of a cross-section taken along line I-I' of FIG. 13 in accordance with some embodiments.
Figure 16:
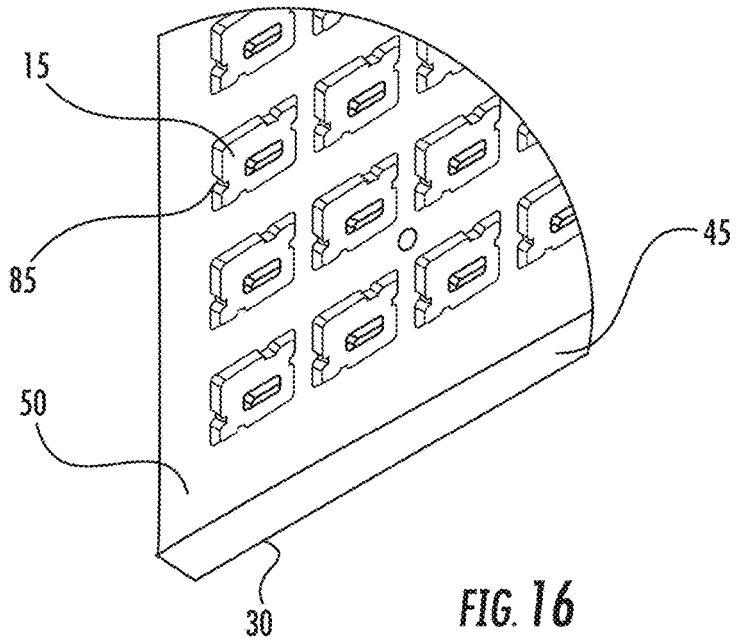
FIG. 16 is a close-up view of the second side of the intermediate layer of FIG. 13 in accordance with some embodiments.

FIGS. 11-17K illustrate embodiments of an array antenna that provide polarization rotation in the signal path. In particular, the embodiments of FIGS. 11-17K include integrated polarization rotator elements in a unitary output layer 75. As shown in the examples of FIGS. 11 and 12, a three-layer structure includes the input layer 35, the intermediate layer 45, and the output layer 75. The waveguide network 5 is provided on the second side 50 of the input layer 35 and the first side 30 of the intermediate layer 45, while the plurality of primary coupling cavities 15 are provided on the second side 50 of the intermediate layer 45 and the first side of the output layer 75.

The output layer 75 is a monolithic layer including the array of horn radiators 25 on the second side 50 thereof, and a plurality of output ports 20 for the primary coupling cavities 15 on the first side 30. The output ports 20 may be generally rectangular in configuration, and multiple (for example, four) of the output ports 20 may be coupled to each of the primary coupling cavities 15. Each of the output ports 20 is also coupled to one of the horn radiators 25 by one or more polarization rotator elements that are integrated (denoted by reference designator 100) in the output layer 75. For example, the output ports 20, horn radiators 25, and polarization rotator elements may be machined into the monolithic output layer 75 from the first side 30 and/or the second side 50 thereof.

Figure 17A:
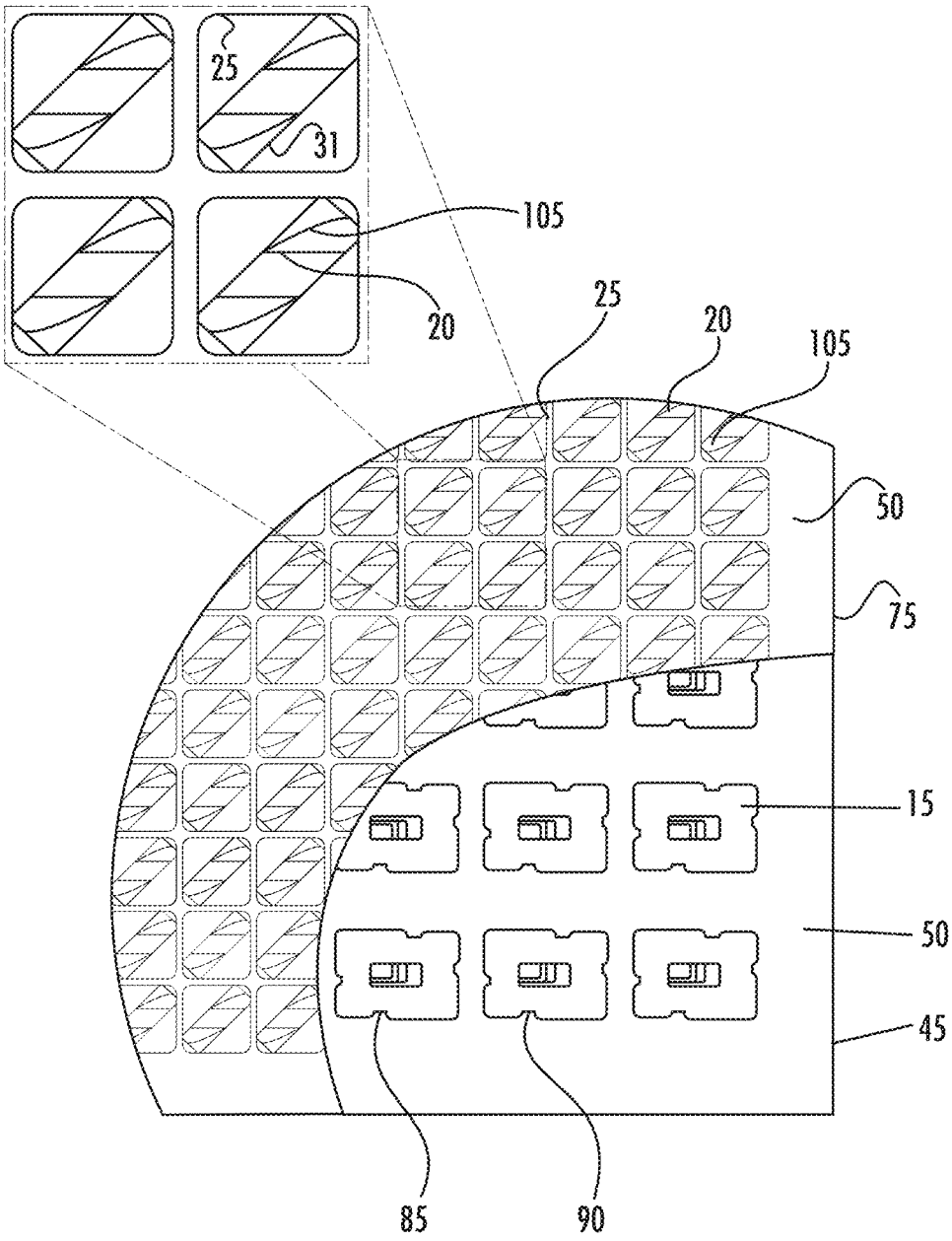
FIG. 17A is a close-up partial cut away front view of FIG. 11 in accordance with some embodiments.
Figure 17B:
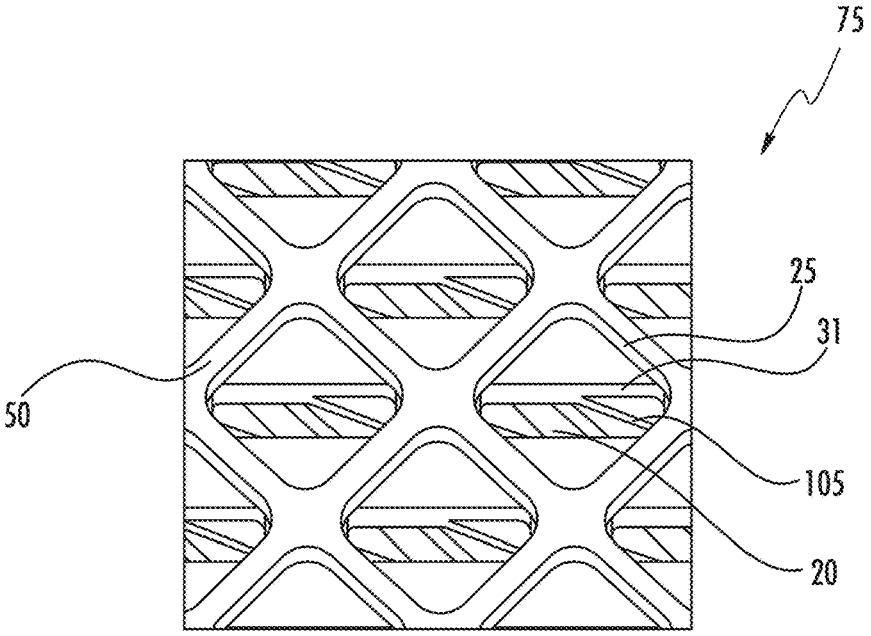
FIG. 17B is a close-up view of the second side of the output layer of FIG. 11 in accordance with some embodiments.
Figure 17C:
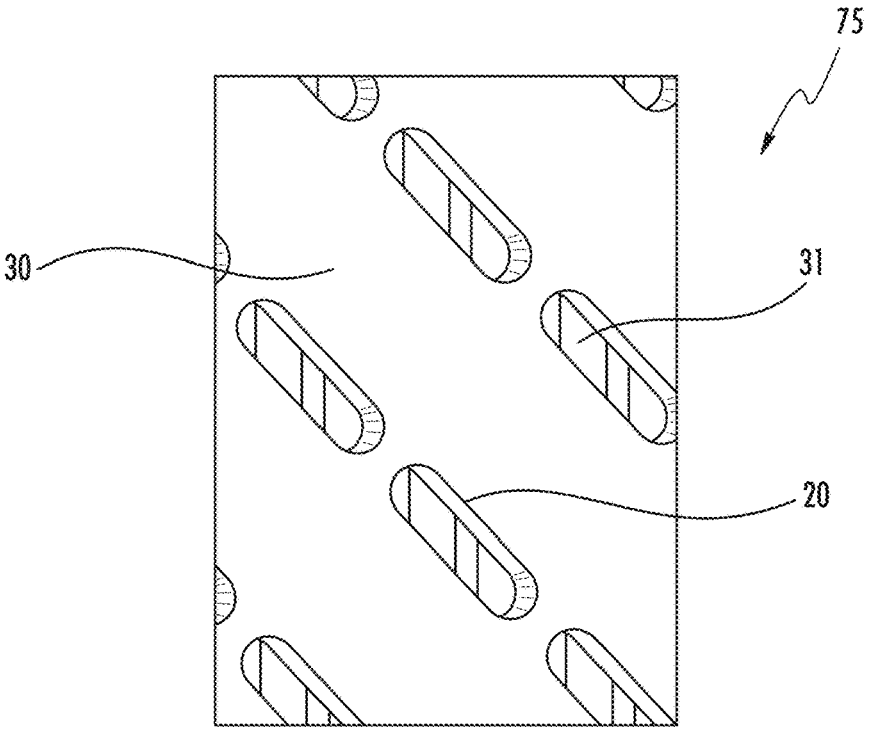
FIG. 17C is a close-up view of the first side of the output layer of FIG. 11 in accordance with some embodiments.

In some embodiments described herein, the polarization rotator elements include one or more multi-sided slots or openings 105 in the output layer 75 that couple each output port 20 to one of the horn radiators 25. In particular, as shown in FIG. 15 and FIGS. 17A-17K, the polarization rotator elements include elongated, generally diamond-shaped slots or openings 105 in the output layer 75. One of the generally diamond-shaped slots 105 is in communication with a respective one of the output ports 20, and couples the respective output port 20 to an inlet port 31 at a base of one of the horn radiators 25. The generally diamond-shaped slot 105 may define an elongated or flattened parallelogram, and may include one or more edges or boundaries that are aligned with those of the inlet port 31 coupled thereto, as shown in FIGS. 17A-17C. Additionally or alternatively, the generally diamond-shaped slots 105 may include one or more edges that are aligned with those of the output port 20 coupled thereto. By confining the dimensions of the generally diamond-shaped slots 105 within those of the inlet port 31 and/or output port 20 coupled thereto, the generally diamond-shaped slots 105 may be machined into the output layer 75 from the first side 30 through the openings defined by the horn radiators 25 and the inlet ports 31, and/or may be machined into the output layer from the second side 50 through the openings defined by the output ports 20. In some embodiments, the horn radiators 25, inlet ports 31, generally diamond-shaped slots or openings 105, and/or output ports 20 may include one or more radiused corners or ends resulting from the machining process.

A longitudinal axis of each generally diamond-shaped slots 105 may be rotated relative to a longitudinal axis of the output port 20 and/or the inlet port 31 coupled thereto, such that the relative longitudinal axes of the output port 20, the generally diamond-shaped slot 105, and/or the inlet port 31 in communication therewith may provide a desired polarization rotation angle between each primary coupling cavity 15 and the horn radiators 25 coupled thereto, with respect to the signal output from each primary coupling cavity 15. For example, the longitudinal axis of an output port 20 may be rotated by a portion (e.g., one-half) of the desired polarization rotation angle with respect to a longitudinal axis of the primary coupling cavity 15, and the longitudinal axis of the generally diamond-shaped slot 105 coupled thereto may be further rotated by a portion (e.g., one-half) of the desired polarization rotation angle with respect to a longitudinal axis of the output port 20. As another example, the longitudinal axis of a generally diamond-shaped slot 105 may be rotated by a portion of the desired polarization rotation angle with respect to a longitudinal axis of the output port 20, and the longitudinal axis of the inlet port 31 coupled thereto may be rotated by a portion of the desired polarization rotation angle with respect to a longitudinal axis of the generally diamond-shaped slot 105 coupled thereto. The longitudinal axis rotation provided by each section of the monolithic output layer 75 is illustrated in the top and bottom perspective views of FIGS. 17D and 17E, and in the corresponding exploded views of the output layer 75 in FIGS. 17F and 17G, respectively.

Figure 17I:
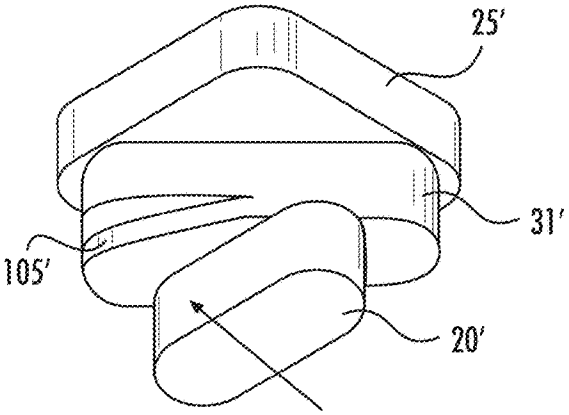
FIG. 17I is a bottom perspective view illustrating a volume of the cavity shown in FIG. 17E in accordance with some embodiments.
Figure 17H:
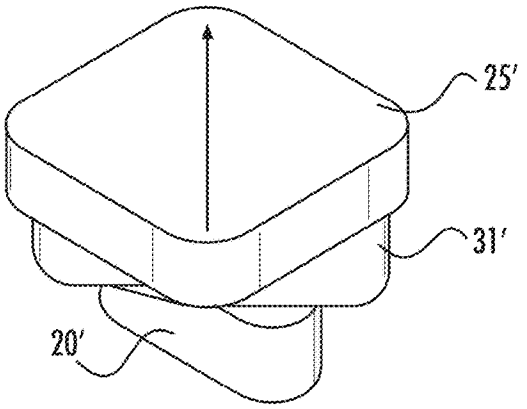
FIG. 17H is a top perspective view illustrating a volume of the cavity shown in FIG. 17D in accordance with some embodiments.
Figure 17E:
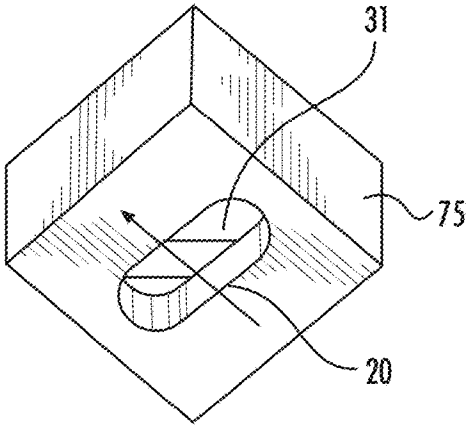
FIG. 17E is a bottom perspective view of a cavity in the output layer of FIG. 11 including a horn radiator, inlet port, polarization rotator, and output port in accordance with some embodiments.
Figure 17D:
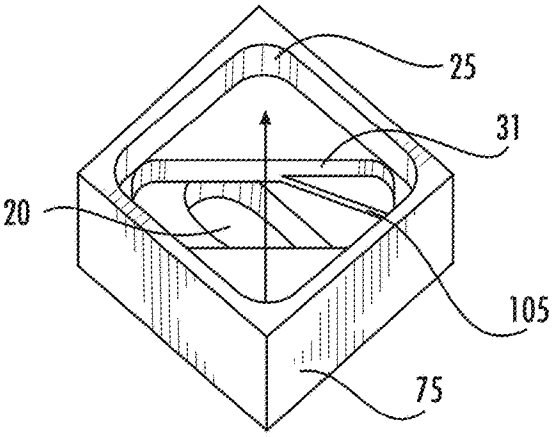
FIG. 17D is a top perspective view of a cavity in the output layer of FIG. 11 including a horn radiator, inlet port, polarization rotator, and output port in accordance with some embodiments.
Figure 17G:
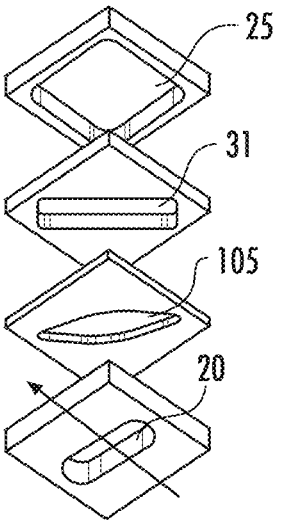
FIG. 17G is an exploded bottom perspective view of the cavity in the output layer including a horn radiator, inlet port, polarization rotator and output port of FIG. 17E in accordance with some embodiments.
Figure 17K:
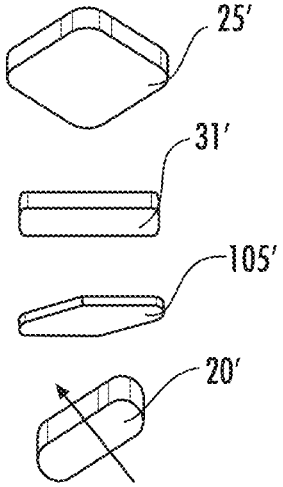
FIG. 17K is an exploded bottom perspective view illustrating a volume of the cavity shown in FIG. 17G in accordance with some embodiments.
Figure 17F:
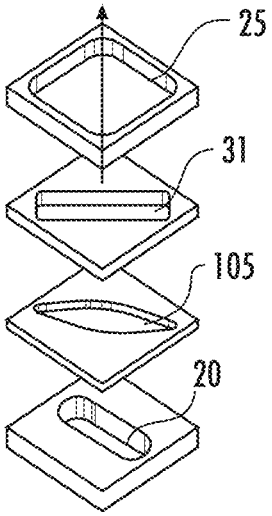
FIG. 17F is an exploded top perspective view of the cavity in the output layer including a horn radiator, inlet port, polarization rotator and output port of FIG. 17D in accordance with some embodiments.
Figure 17J:
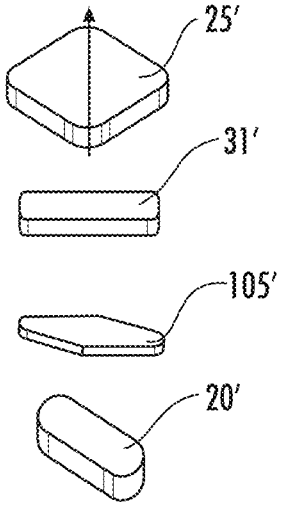
FIG. 17J is an exploded top perspective view illustrating a volume of the cavity shown in FIG. 17F in accordance with some embodiments.
Figure 18:
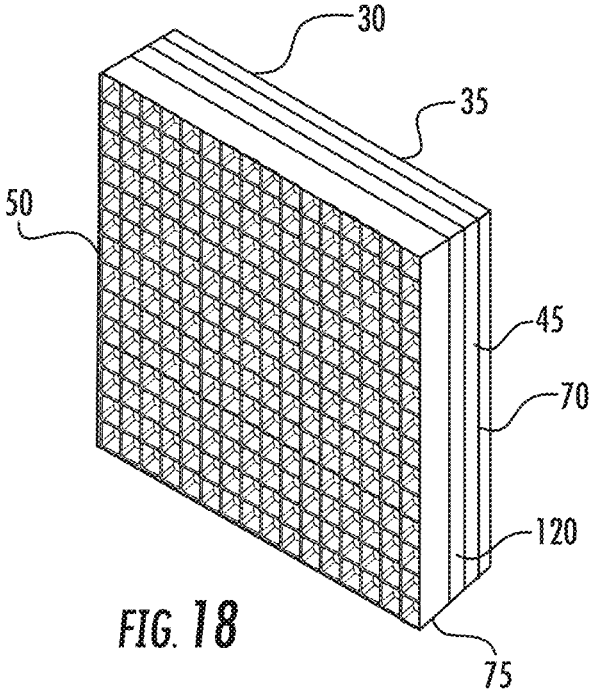
FIG. 18 is a schematic isometric angled front view of a flat panel antenna including a second intermediate layer in accordance with further embodiments.
Figure 19:
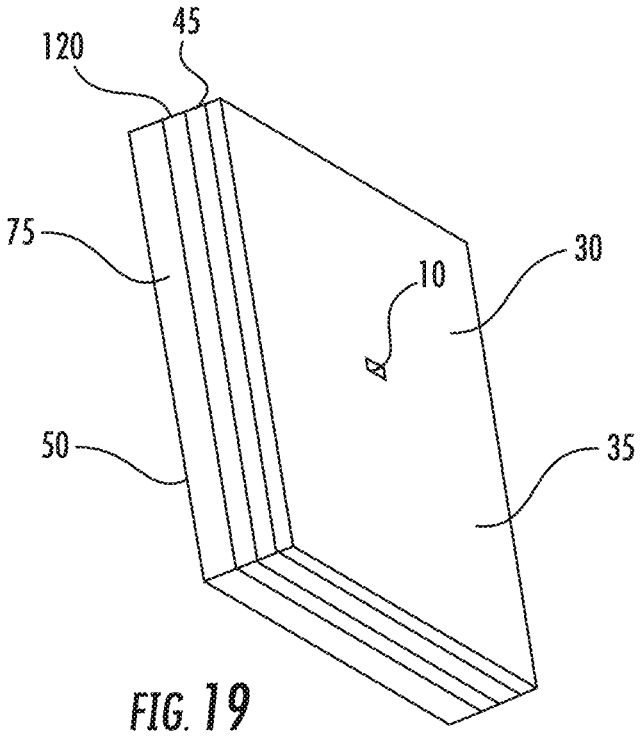
FIG. 19 is a schematic isometric angled back view of the flat panel antenna of FIG. 18 in accordance with further embodiments.
Figure 20:
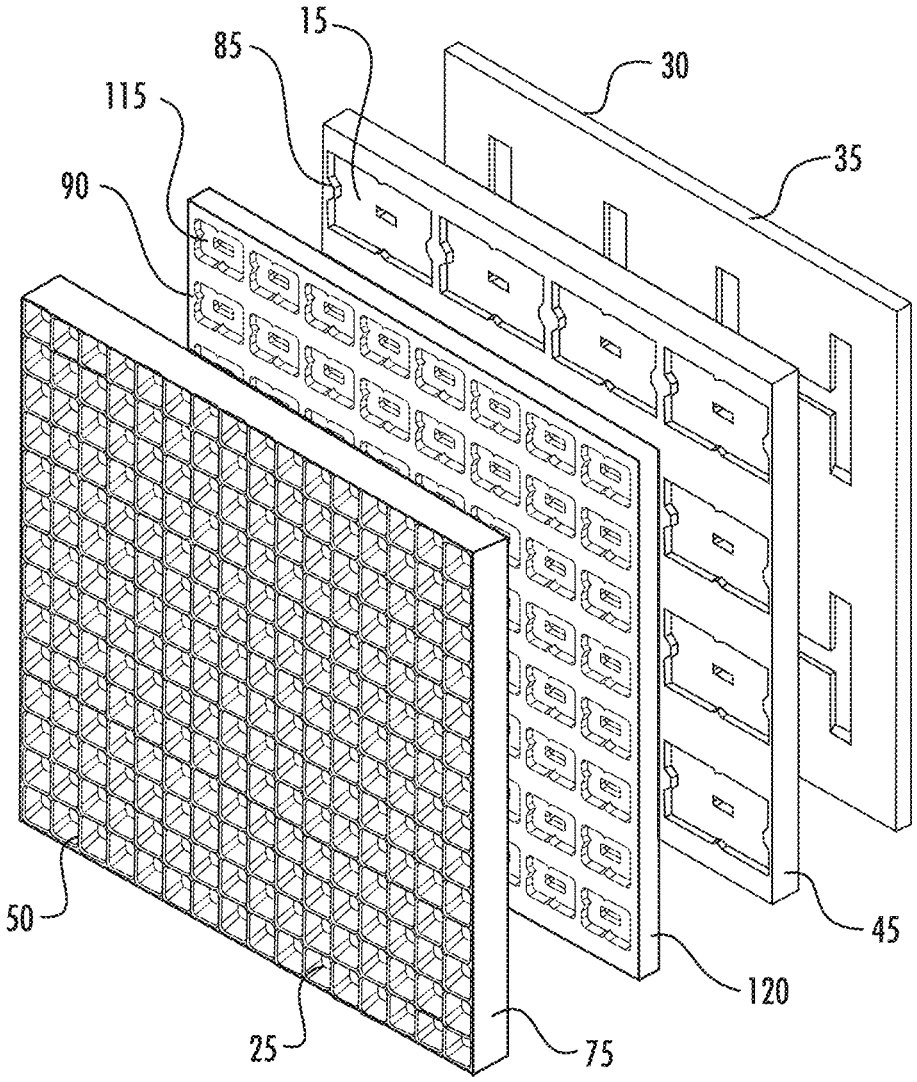
FIG. 20 is a schematic isometric exploded view of FIG. 18 in accordance with further embodiments.
Figure 21:
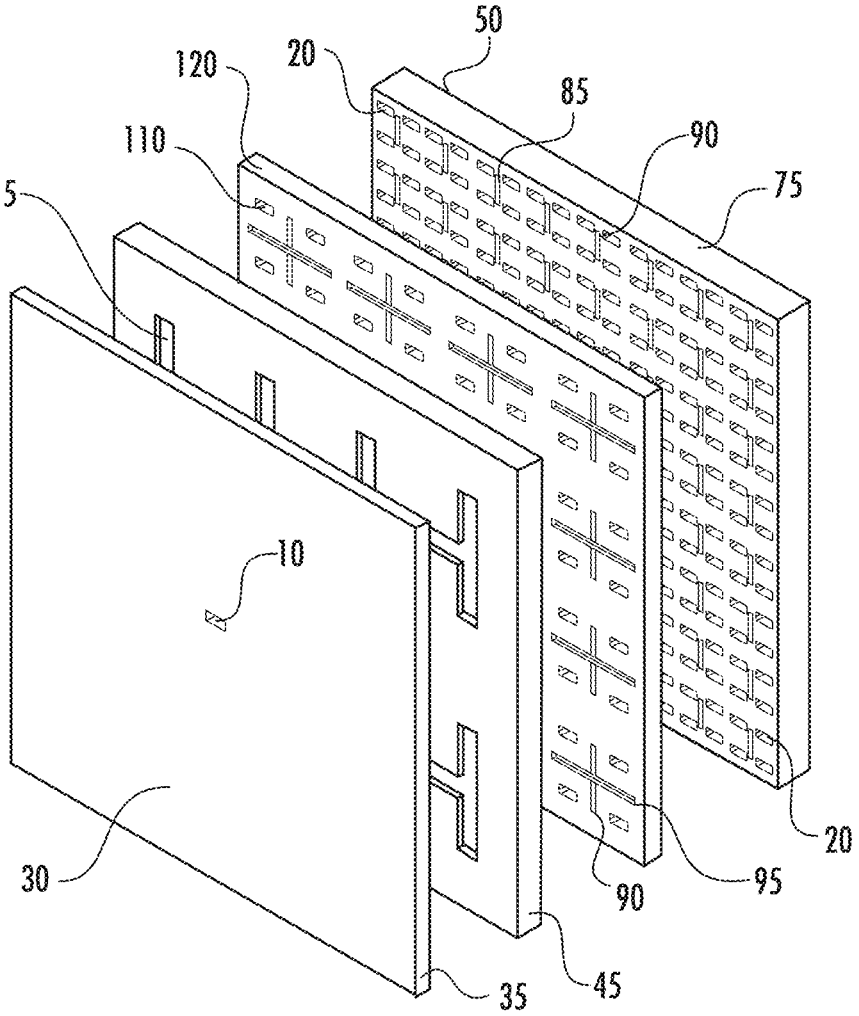
FIG. 21 is a schematic isometric exploded view of FIG. 19 in accordance with further embodiments.

The polarization rotation effects provided by each section of the monolithic output layer are illustrated by the air volumes defined within the monolithic output layer 75 shown in the top and bottom perspective views of FIGS. 17H and 17I, and the corresponding exploded views of FIGS. 17J and 17K, respectively. In some embodiments, each generally diamond-shaped slot 105 may be rotated by one-half of the desired polarization rotation angle, and the longitudinal axis of the output port 20 and/or the inlet port 31 coupled thereto may be rotated by the remaining one-half of the desired polarization rotation angle with respect to a longitudinal axis of the primary coupling cavity 15. One skilled in the art will thus appreciate that the number and/or shape of polarization rotator elements 105 provided between a coupling cavity output port 20 and an inlet port 31 of a horn radiator 25 may be increased or altered, with the division of the desired rotation angle further distributed between the additional polarization rotator elements 105.

FIGS. 28A-28E illustrate further embodiments of an output layer 75 of the array antenna shown in the examples of FIGS. 11 and 12. The output layer 75 includes the array of horn radiators 25 on the second side 50 thereof, and a plurality of output ports 20 for the primary coupling cavities 15 on the first side 30. The output ports 20 may be generally rectangular in configuration, and multiple (for example, four) of the output ports 20 may be coupled to each of the primary coupling cavities 15. Each of the output ports 20 is also coupled to one of the horn radiators 25 by one or more polarization rotator elements 105*x* that are integrated (denoted by reference designator 100 in FIG. 12) in the output layer 75. For example, the output ports 20, horn radiators 25, and polarization rotator elements 105*x* may be machined into the output layer 75 from the first side 30 and/or the second side 50 thereof.

In particular, the embodiments of FIGS. 28A-28D include integrated polarization rotator elements 105*x* in a unitary or monolithic output layer 75. As shown in FIG. 28E, the polarization rotator elements 105*x* may be elongated, slot-shaped openings in the output layer 75. One of the slot-shaped openings 105*x* is in communication with a respective one of the output ports 20, and couples the respective output port 20 to an inlet port 31 at a base of one of the horn radiators 25. By confining the dimensions of the slot-shaped openings 105*x* within those of the inlet port 31 and/or output port 20 coupled thereto, the slot-shaped openings 105*x* may be machined into the output layer 75 from the first side 30 through the openings defined by the horn radiators 25 and the inlet ports 31, and/or may be machined into the output layer from the second side 50 through the openings defined by the output ports 20. In some embodiments, the horn radiators 25, inlet ports 31, slot-shaped openings 105*x*, and/or output ports 20 may include one or more radiused corners or ends resulting from the machining process.

A longitudinal axis of each slot-shaped opening 105*x* may be rotated relative to a longitudinal axis of the output port 20 and/or the inlet port 31 coupled thereto, such that the relative longitudinal axes of the output port 20, the slot-shaped opening 105*x*, and/or the inlet port 31 in communication therewith may provide a desired polarization rotation angle between each primary coupling cavity 15 and the horn radiators 25 coupled thereto, with respect to the signal output from each primary coupling cavity 15. For example, the longitudinal axis of an output port 20 may be rotated by a portion of the desired polarization rotation angle with respect to a longitudinal axis of the primary coupling cavity 15, and the longitudinal axis of the slot-shaped opening 105*x* coupled thereto may be further rotated by a portion of the desired polarization rotation angle with respect to a longitudinal axis of the output port 20. However, it will be understood that the desired polarization rotation angle need not be equally-divided between the longitudinal axes of the output port 20 and the slot-shaped rotator element 105*x*. As another example, the longitudinal axis of a slot-shaped opening or rotator element 105*x* may be rotated by a portion of the desired polarization rotation angle with respect to a longitudinal axis of the output port 20, and the longitudinal axis of the inlet port 31 coupled thereto may be rotated by a portion of the desired polarization rotation angle with respect to a longitudinal axis of the slot-shaped opening 105*x* coupled thereto. However, the longitudinal axis of the output ports 20 may be parallel with or "square" to that of the coupling cavity 15 in some embodiments, so as to more equally divide energy between the four output ports 20. The longitudinal axis rotation provided by each section of the monolithic output layer 75 is illustrated in the top and bottom perspective views of FIGS. 28A and 28C, respectively.

Figure 28D:
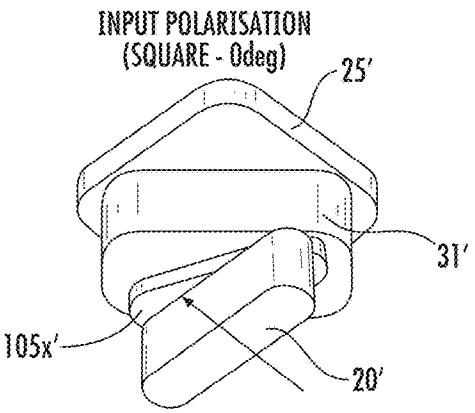
FIG. 28D is a bottom perspective view illustrating a volume of the cavity shown in FIG. 28C in accordance with some further embodiments.
Figure 28B:
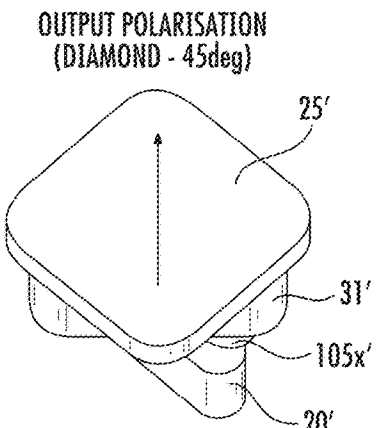
FIG. 28B is a top perspective view illustrating a volume of the cavity shown in FIG. 28A in accordance with some further embodiments.
Figure 28C:
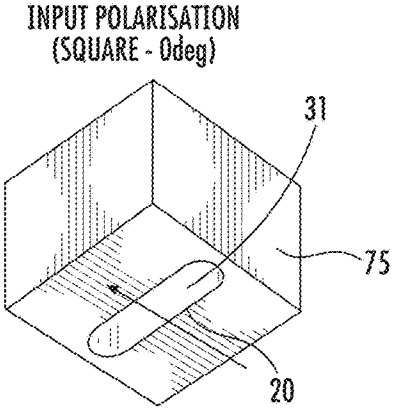
FIG. 28C is a bottom perspective view of a cavity in the output layer of FIG. 11 including a horn radiator, inlet port, polarization rotator, and output port in accordance with some further embodiments.
Figure 28A:
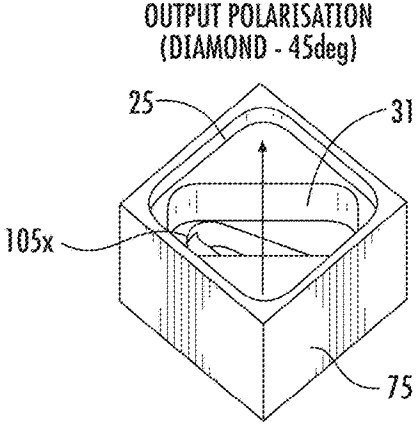
FIG. 28A is a top perspective view of a cavity in the output layer of FIG. 11 including a horn radiator, inlet port, polarization rotator, and output port in accordance with some further embodiments.
Figure 28E:
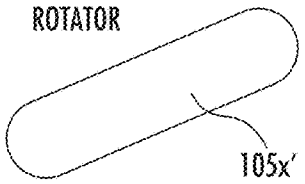
FIG. 28E is a close-up view of the polarization rotator taken along line I-I' of FIG. 13 in accordance with some further embodiments.

The polarization rotation effects provided by each section of the monolithic output layer 75 are illustrated by the air volumes defined within the monolithic output layer 75 shown in the top and bottom perspective views of FIGS. 28B and 28D, respectively. In some embodiments, each slot-shaped opening 105*x*' may be rotated by a portion of the desired polarization rotation angle, and the longitudinal axis of the output port 20' and/or the inlet port 31' coupled thereto may be rotated by a remaining portion of the desired polarization rotation angle with respect to a longitudinal axis of the primary coupling cavity 15. One skilled in the art will thus appreciate that the number and/or shape of polarization rotator elements 105*x*' provided between a coupling cavity output port 20' and an inlet port 31' of a horn radiator 25' may be increased or altered, with at least some division of the desired rotation angle distributed therebetween.

Figure 2:
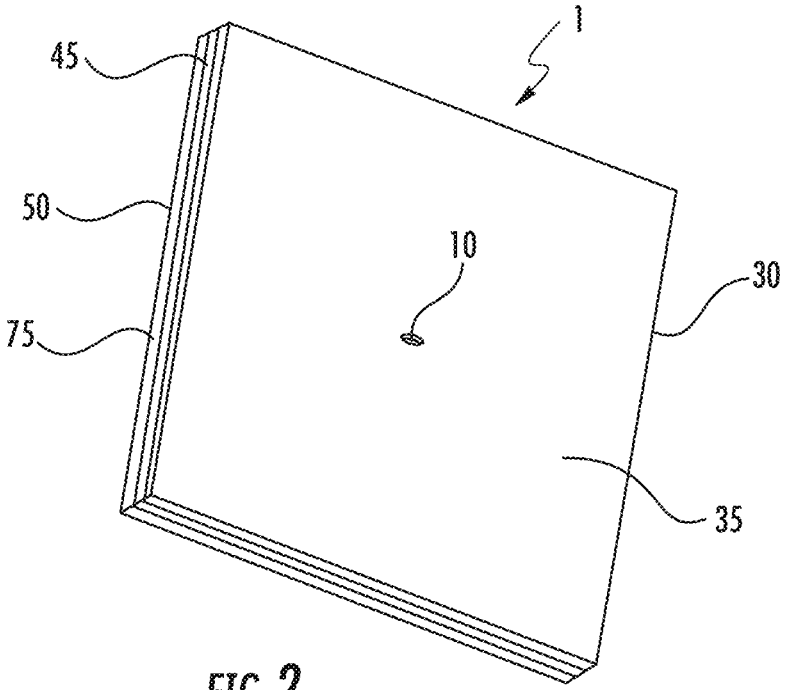
FIG. 2 is a schematic isometric angled back view of the flat panel antenna of FIG. 1 in accordance with some embodiments.

FIGS. 29A-29D illustrate further embodiments of an output layer 75 of the array antenna shown in the examples of FIGS. 1 and 2. The output layer 75 includes the array of horn radiators 25 on the second side 50 thereof, and a plurality of slot-shaped output ports 20 for the primary coupling cavities 15 on the first side 30. The output ports 20 may be generally rectangular in configuration, and multiple (for example, four) of the output ports 20 may be coupled to each of the primary coupling cavities 15. Each of the output ports 20 is also coupled to one of the horn radiators 25*x* by an inlet port 31, all of which are integrated in a unitary or monolithic output layer 75. For example, the output ports 20, horn radiators 25*x*, and inlet ports 31 may be machined into the monolithic output layer 75 from the first side 30 and/or the second side 50 thereof.

In particular, in the embodiments of 29A-29D, the elements or openings 20, 31, and 25*x* in the monolithic output layer 75 are configured to provide respective output signals from the horn radiators 25*x* having a polarization orientation that is rotated relative to the polarization orientation of respective input signals received at the respective output ports 20 coupled thereto. That is, features (e.g., shapes and/or orientations) of the horn radiators 25*x*, the respective horn radiator inlet ports 31, and/or the respective output ports 20 relative to one another are configured to collectively rotate the polarization orientation of the respective input signals received at the respective output ports 20 by a desired polarization rotation angle, without the presence of a dedicated polarization rotator element (such as the polarization rotation elements 105 or 105*x* discussed above) integrated in the output layer 75. The embodiments of FIGS. 29A-29D may thus allow for reduced complexity of the output layer 75. However, as more clearly illustrated by the air volumes defined within the monolithic output layer 75 shown in the top and bottom perspective views of FIGS. 29B and 29D, respectively, the thicknesses of the horn radiator 25*x*' and/or the horn inlet port 31' may be increased to achieve the desired RF performance, which may increase the overall thickness of the output layer 75. Also, as shown in FIGS. 29A-29D, the horn radiators 25*x* may have a more complex geometry (illustrated as hexagonally-shaped).

The dimensions of the inlet ports 31 may be confined within those of the horn radiators 25*x*, such that the inlet ports 31 may be machined into the output layer 75 from the first side 30 through the openings defined by the horn radiators 25*x*. In some embodiments, the horn radiators 25*x*, inlet ports 31, and/or output ports 20 may include one or more radiused corners or ends resulting from the machining process.

A longitudinal axis of each inlet port 31 may be rotated relative to a longitudinal axis of the output port 20 coupled thereto, such that the relative longitudinal axes of the output port 20 and the inlet port 31 in communication therewith may provide a desired polarization rotation angle between each primary coupling cavity 15 and the horn radiators 25*x* coupled thereto, with respect to the signal output from each primary coupling cavity 15. For example, the longitudinal axis of an output port 20 may be rotated by a portion of the desired polarization rotation angle (or may be parallel) with respect to a longitudinal axis of the primary coupling cavity 15, and the longitudinal axis of the inlet port 31 coupled thereto may be further rotated by a remaining portion of (or by an entirety of) the desired polarization rotation angle with respect to a longitudinal axis of the output port 20. However, the longitudinal axis of the output ports 20 may be parallel with or "square" to that of the coupling cavity 15 in some embodiments, so as to more equally divide energy between the four output ports 20. More generally, it will be understood that the desired polarization rotation angle relative to the longitudinal axis of the primary coupling cavity 15 may be divided between the longitudinal axes of the output port 20 and the inlet port 31, but need not be equally divided. The longitudinal axis rotation provided by each section of the monolithic output layer 75 is illustrated in the top and bottom perspective views of FIGS. 29A and 29C, respectively.

Figure 29C:
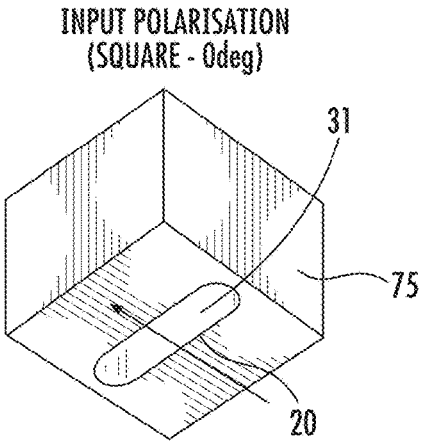
FIG. 29C is a bottom perspective view of a cavity in the output layer of FIG. 1, including a horn radiator, inlet port, and output port, which are configured to provide a desired polarization rotation in accordance with some embodiments.
Figure 29D:
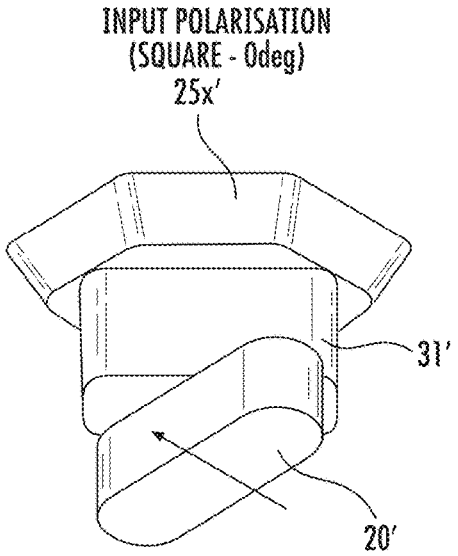
FIG. 29D is a bottom perspective view illustrating a volume of the cavity shown in FIG. 29C in accordance with some embodiments.
Figure 29A:
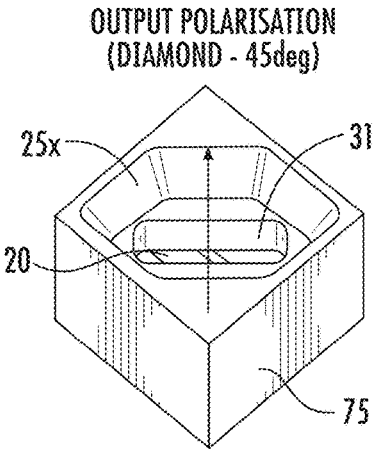
FIG. 29A is a top perspective view of a cavity in the output layer of FIG. 1 including a horn radiator, inlet port, and output port, which are configured to provide a desired polarization rotation in accordance with some embodiments.
Figure 29B:
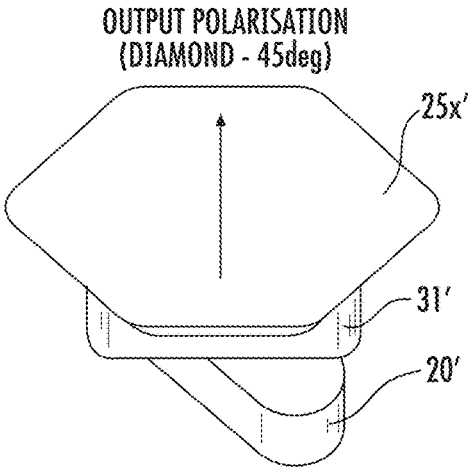
FIG. 29B is a top perspective view illustrating a volume of the cavity shown in FIG. 29A in accordance with some embodiments.

The polarization rotation effects provided by each section of the monolithic output layer 75 are illustrated by the air volumes defined within the monolithic output layer 75 shown in the top and bottom perspective views of FIGS. 29B and 29D, respectively. In some embodiments, each inlet port 31' may be rotated by at least a portion of (or in some embodiments, an entirety of) the desired polarization rotation angle, and the longitudinal axis of the output port 20' may be may be parallel with or correspond to a longitudinal axis of the primary coupling cavity 15.

FIGS. 30A-30H illustrate further embodiments of an output layer 75 of the array antenna shown in the examples of FIGS. 1 and 2. The output layer 75 includes the array of horn radiators 25 on the second side 50 thereof, and a plurality of slot-shaped output ports 20$x$ for the primary coupling cavities 15 on the first side 30. In the embodiments of FIGS. 30A-30H, each of the output ports 20$x$ may include elliptical-shaped end portions coupled by an elongated slot extending therebetween along a longitudinal axis thereof (also referred to herein as a double-ridge slot 20$x$), and multiple (for example, four) of the output ports 20$x$ may be coupled to each of the primary coupling cavities 15. Each of the output ports 20$x$ is also coupled to a respective one of the horn radiators 25 by an inlet port 31, all of which are integrated in a unitary or monolithic output layer 75. For example, the output ports 20$x$, horn radiators 25, and inlet ports 31 may be machined into the monolithic output layer 75 from the first side 30 and/or the second side 50 thereof.

In particular, in the embodiments of FIGS. 30A-30H, the elements or openings 20$x$, 31, and 25 in the monolithic output layer 75 are configured to provide respective output signals from the horn radiators 25 having a polarization orientation that is rotated relative to the polarization orientation of respective input signals received at the respective double-ridge slot-shaped output ports 20$x$ coupled thereto. That is, features (e.g., shapes and/or orientations) of the horn radiators 25, the respective horn radiator inlet ports 31, and/or the respective output ports 20$x$ relative to one another are configured to collectively rotate the polarization orientation of the respective input signals received at the respective output ports 20$x$ by a desired polarization rotation angle, without the presence of a dedicated polarization rotator element (such as the polarization rotation elements 105 or 105$x$ discussed above) integrated in the output layer 75. The embodiments of FIGS. 30A-30H may thus allow for reduced complexity of the output layer 75. In addition, as illustrated by the air volumes defined within the monolithic output layer 75 shown in the top and bottom perspective views of FIGS. 30B and 30D, respectively, the thicknesses of the horn radiator 25', the horn inlet port 31', and the output port 20$x$' may be substantially similar or unchanged (relative to the corresponding features 25/25', 31/31', and 20/20' in the embodiments including the dedicated polarization rotation elements 105 or 105$x$), such that the desired RF performance may be achieved while maintaining (or without substantially altering) the overall thickness of the output layer 75.

Likewise, as shown in FIGS. 30A-30H, the geometry of horn radiators 25 may substantially unchanged relative to the embodiments including the dedicated polarization rotation elements 105 or 105$x$. That is, each of the horn radiators 25 may include sidewalls that uniformly extend around a perimeter thereof from a base including one of the respective horn radiator inlet ports 31 therein. The dimensions of the inlet ports 31 may be similarly confined within those of the horn radiators 25, such that the inlet ports 31 may be machined into the output layer 75 from the first side 30 through the openings defined by the horn radiators 25. In some embodiments, the horn radiators 25, inlet ports 31, and/or output ports 20$x$ may include one or more radiused corners or ends resulting from the machining process.

A longitudinal axis of each inlet port 31 may be rotated relative to a longitudinal axis of the output port 20$x$ coupled thereto, such that the relative longitudinal axes of an output port 20$x$ and the inlet port 31 in communication therewith may provide a desired polarization rotation angle between each primary coupling cavity 15 and the horn radiators 25 coupled thereto, with respect to the signal output from each primary coupling cavity 15. For example, the longitudinal axis of an output port 20$x$ may be rotated by a portion of the desired polarization rotation angle (or may be parallel) with respect to a longitudinal axis of the primary coupling cavity 15, while the longitudinal axis of the inlet port 31 coupled thereto may be rotated by a remaining portion of (or by an entirety of) the desired polarization rotation angle with respect to a longitudinal axis of the output port 20$x$. If the longitudinal axis of the output ports 20 are parallel with or "square" to that of the coupling cavity 15, energy may be more equally divided between the four output ports 20. However, it will be understood that the desired polarization rotation angle relative to the longitudinal axis of the primary coupling cavity 15 may be divided between the longitudinal axes of the output port 20$x$ and the inlet port 31, but need not be equally divided. The longitudinal axis rotation provided by each section of the monolithic output layer 75 is illustrated in the top and bottom perspective views of FIGS. 30A and 30C, respectively.

Figure 30C:
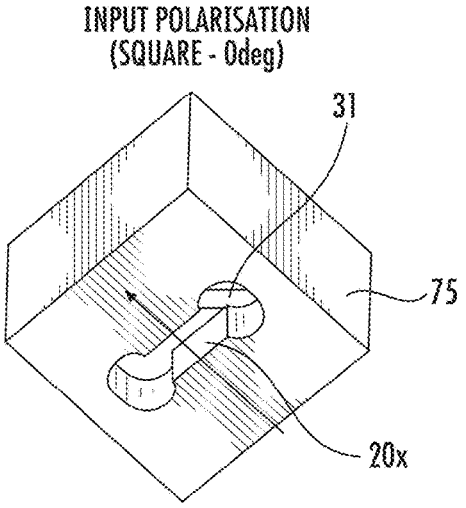
FIG. 30C is a bottom perspective view of a cavity in the output layer of FIG. 1 including a horn radiator, inlet port, and double-ridge output port, which are configured to provide a desired polarization rotation in accordance with some embodiments.
Figure 30D:
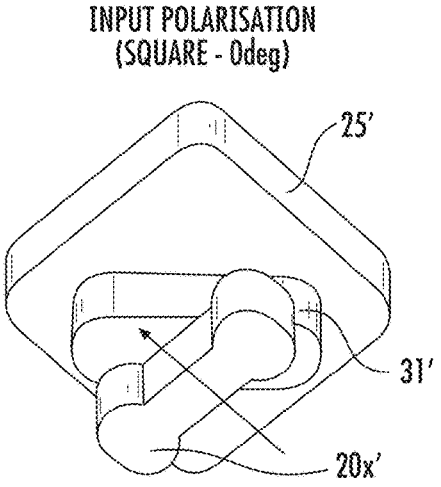
FIG. 30D is a bottom perspective view illustrating a volume of the cavity shown in FIG. 30C in accordance with some embodiments.
Figure 30A:
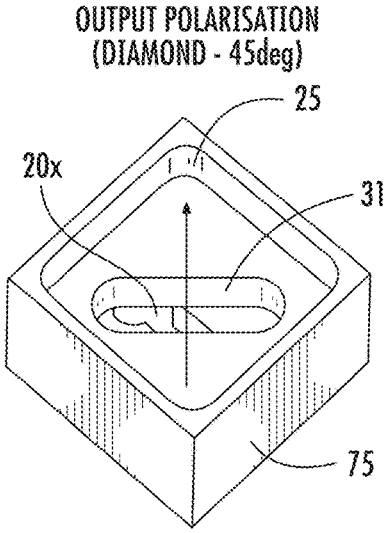
FIG. 30A is a top perspective view of a cavity in the output layer of FIG. 1 including a horn radiator, inlet port, and double-ridge output port, which are configured to provide a desired polarization rotation in accordance with some embodiments.
Figure 30B:
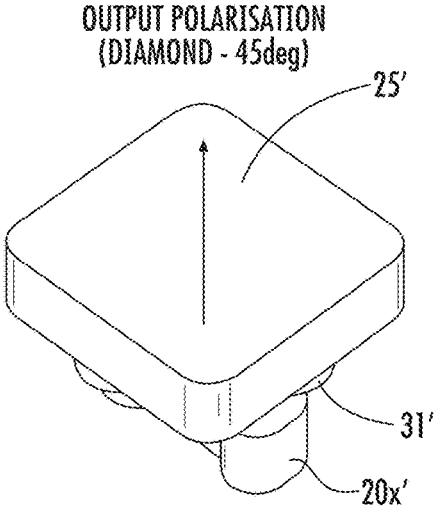
FIG. 30B is a top perspective view illustrating a volume of the cavity shown in FIG. 30A in accordance with some embodiments.
Figure 30E:
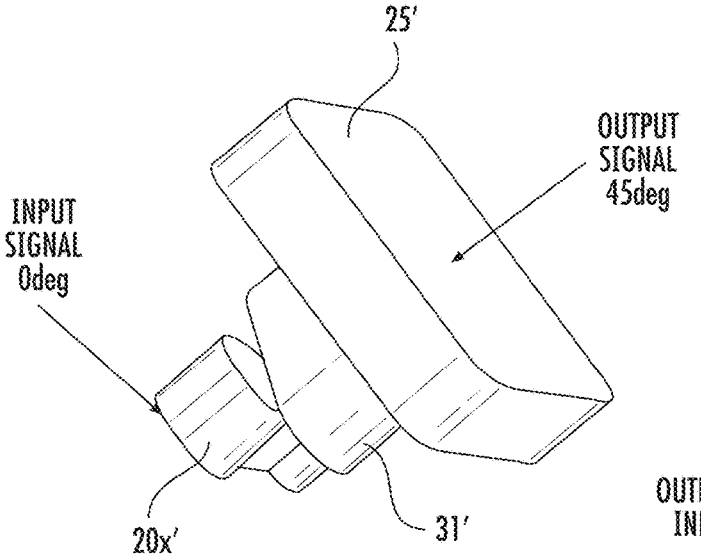
FIG. 30E is a side perspective view illustrating a volume of the cavity shown in FIGS. 30A and 30C in accordance with some embodiments.
Figure 30F:
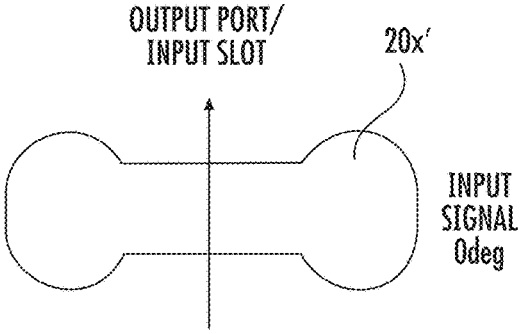
FIG. 30F is a close-up view illustrating a shape of the double-ridge output port of FIGS. 30A and 30C in accordance with some embodiments.
Figure 30G:
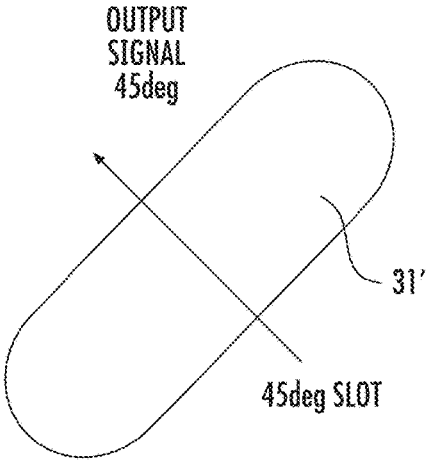
FIG. 30G is a close-up view illustrating a shape of the horn inlet port of FIGS. 30A and 30C in accordance with some embodiments.
Figure 30H:
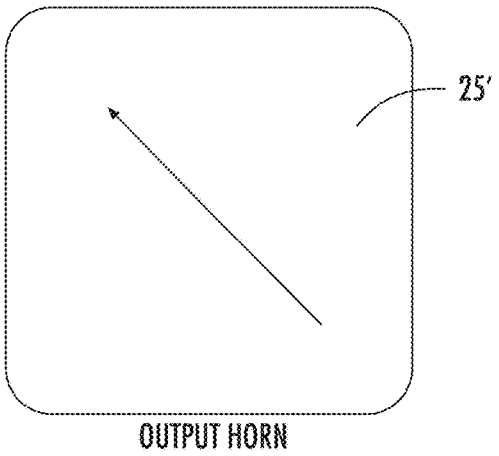
FIG. 30H is a close-up view illustrating a shape of the horn radiator of FIGS. 30A and 30C in accordance with some embodiments.

The polarization rotation effects provided by each section of the monolithic output layer 75 are illustrated by the air volumes defined within the monolithic output layer 75 shown in the top, bottom, and side perspective views of FIGS. 30B, 30D, and 30E, respectively. The respective shapes and orientations of the input slot/output port 20$x$', the horn inlet port 31', and the horn radiator 25' are shown in the plan views of FIGS. 30F, 30G, and 30H, respectively. As noted above, each inlet port 31' may be rotated by at least a portion of (or in some embodiments, an entirety of) the desired polarization rotation angle relative to the longitudinal axis of the output port 20$x$', while the longitudinal axis of the output port 20$x$' may be parallel with or correspond to a longitudinal axis of the primary coupling cavity 15.

Figure 31:
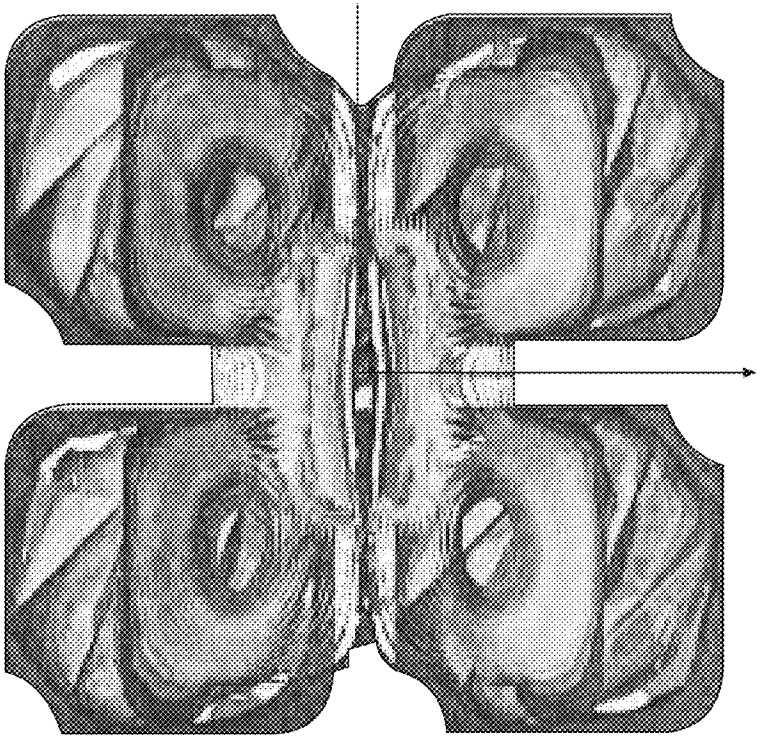
FIG. 31 is a plot illustrating electromagnetic field control provided by an output layer including the horn radiator, inlet port, integrated diamond-shaped polarization rotator, and output port of FIGS. 17A-17K in accordance with embodiments.
Figure 32:
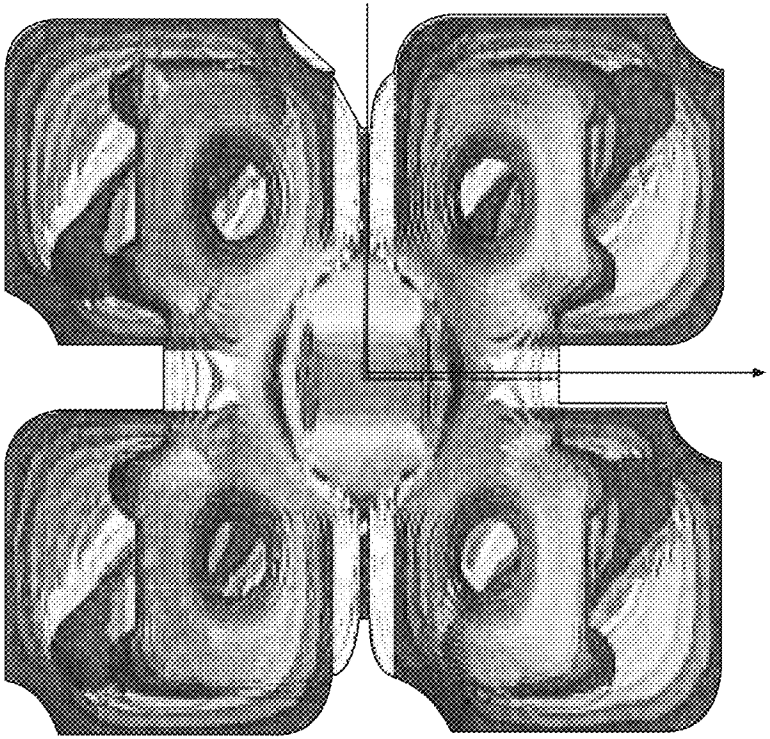
FIG. 32 is a plot illustrating electromagnetic field control provided by an output layer including the horn radiator, inlet port, and double-ridge output port of FIGS. 30A-30H in accordance with some embodiments.

FIG. 31 is a plot illustrating electromagnetic field control provided by an output layer including the horn radiator 25, inlet port 31, diamond-shaped integrated polarization rotator 105, and output port 20 of FIGS. 17A-17K in accordance with embodiments, while FIG. 32 is a plot illustrating electromagnetic field control provided by an output layer including the horn radiator 25, inlet port 31, and double-ridge slot-shaped output port 20$x$ of FIGS. 30A-30H in accordance with some embodiments. As shown by comparison of FIGS. 31 and 32, the output layer including the double-ridge slot-shaped output ports 20$x$ may provide tighter field control and improved field separation in the "common region" that is positioned between four output ports 20$x$ coupled to the same primary coupling cavity 15, where energy may split from the single mode waveguide input provided by the input layer 35. In particular, in the common region of the output layer including the double-ridge slot-shaped output ports 20$x$ shown in FIG. 32, the fields appear to be more distinct (or "snap to attention") relative to the more vague field definition in the common region of the output layer including the diamond-shaped polarization rotator elements 105 shown in FIG. 31. In some embodiments, this comparative advantage may allow for fabrication of the output layer including the double-ridge slot-shaped output ports 20$x$ with shorter lengths for assembly. In other words, the design including the double-ridge slot-shaped output ports 20$x$ can result in a thinner monolithic output layer, while maintaining similar performance.

Referring again to the views of FIGS. 17D-17K, 28A-28D, 29A-29D, and 30A-30H, where the desired rotation angle is 45 degrees for the output polarization from the horn radiator 25 with respect to the input polarization at the input feed 10 (illustrated as "square" or 0 degree input polarization and "diamond" or 45 degree output polarization), the flat panel antenna 1 may be mounted in a "diamond" orientation, rather than "square" orientation (with respect to the azimuth axis). In this orientation, the flat panel antenna 1 may benefit from improved signal patterns, particularly with respect to horizontal or vertical polarization, as the diamond orientation may increase or maximize the number of horn radiators along each of these axes along with advantages of the array factor. To assist with signal routing to off axis diamond-shaped openings 105 and/or output ports 20, tuning features 85 of the primary coupling cavity 15 may similarly be shifted into an asymmetrical alignment weighted toward ends of adjacent diamond-shaped openings 105 and/or output ports 20, as shown for example in FIG. 16.

Further simplification of the waveguide network 5 may be obtained by applying additional layers of coupling cavities. For example, instead of being coupled directly to the output ports 20, each of the primary coupling cavities 15 may feed intermediate ports 110 coupled to secondary coupling cavities 115 again each with four output ports 20, each of the output ports 20 coupled to a horn radiator 25. Thereby, the horn radiator 25 concentration may be increased by a further factor of 4 and the paired primary and secondary coupling cavities 15, 115 can result in −12 dB coupling (−6 dB/coupling cavity), comparable to an equivalent corporate waveguide network, but which can significantly reduce the need for extensive high density waveguide layout gyrations required to provide equivalent electrical lengths between the input feed 10 and each output port 20.

As shown for example in FIGS. 18-21, the waveguide network 5 may be similarly formed on a second side 50 of an input layer 35 and a first side 30 of a first intermediate layer 45. The primary coupling cavities 15 are again provided on a second side 50 of the first intermediate layer 45. Intermediate ports 110 are provided on a first side 30 of a second intermediate layer 120, aligned with the primary coupling cavities 15. The secondary coupling cavities 115 are provided on a second side 50 of the second intermediate layer 120, aligned with the output ports 20 provided on the first side 30 of the output layer 75, the horn radiators 25 provided as an array of horn radiators 25 on a second side 50 of the output layer 75. Tuning features 85 may also be applied to the secondary coupling cavities 115, as described with respect to the primary coupling cavities 15, herein above.

Alternatives described herein above with respect to the split of the waveguide network 5 features between adjacent layer sides may be similarly applied to the primary and/or secondary coupling cavities 15, 115. For example, a midwall of the coupling cavities (over respective thicknesses thereof) may be applied at the layer joint, such that portions of the coupling cavities are provided in each side of the adjacent layers. In an embodiment having primary and secondary coupling cavities 15, 115, the dimensions of the primary coupling cavity 15 may be, for example, approximately 3×2×0.18 wavelengths, while the dimensions of the secondary coupling 115 may be 1.5×1×0.18 wavelengths.

The array of horn radiators 25 on the second side 50 of the output layer 75 may improve directivity (gain), with gain increasing with element aperture until element aperture increases beyond one wavelength (with respect to the desired operating frequency range), at which point grating lobes may begin to be introduced. In some embodiments, the desired frequency range for the antenna 1 may be between about 15 GHz and 40 GHz. One skilled in the art will appreciate that, because each of the horn radiators 20 is individually coupled in phase to the input feed 10, a low density ½ wavelength output slot spacing that may typically be applied to follow propagation peaks within a common feed waveguide slot configuration may be eliminated, allowing closer horn radiator 20 spacing and thus higher overall antenna gain. Because an array of small horn radiators 20 with common phase and amplitude are provided, the amplitude and phase tapers that may be observed in some conventional single large horn configurations and that may otherwise require adoption of an excessively deep horn or reflector antenna configuration can be eliminated.

One skilled in the art will appreciate that the simplified geometry of the coupling cavities and corresponding reduction of the waveguide network requirements may enable significant simplification of the required layer surface features, which can reduce overall manufacturing complexity. For example, the input, first intermediate, and second intermediate (if present), layers 35, 45, 120 may be formed cost effectively with high precision in high volumes via injection molding and/or die-casting technology. Where injection molding with a polymer material is used to form the layers, a conductive surface may be applied. In addition, the output layer 75 including the integrated horn radiators 25/25*x*, inlet ports 31, and output ports 20/20*x* (and, in some embodiments, polarization rotator elements 105/105*x*) can be machined from a monolithic or unitary layer, thereby reducing fabrication costs, for example with respect to complexity and layer alignment. Although the coupling cavities and waveguides are described as rectangular, for ease of machining and/or mold separation, corners or end portions may be radiused and/or rounded in a trade-off between electrical performance and manufacturing efficiency.

The input layer 35, intermediate layer(s) 45, 120, and/or output layers 75, may be assembled using various techniques, including but not limited to mechanical fixings, brazing, diffusion bonding, and lamination. For example, two or more of the layers 35, 45, 120, and/or 75 may be joined by a brazing process, using a filler metal (having a lower melting point than the layers) at the seams between the layers. Additionally or alternatively, two or more of the layers 35, 45, 120, and/or 75 may be joined using a diffusion bonding process, by clamping two or more of the layers together with respective surfaces abutting, and applying pressure and heat to bond the layers. Such brazing and/or diffusion bonding processes can provide very good bonding between plates, which may result in lower electrical losses and/or reduced or minimized RF leakage.

As frequency increases, wavelengths decrease. Therefore, as the desired operating frequency increases, the physical features within a corporate waveguide network, such as steps, tapers and T-type power dividers, may become smaller and harder to fabricate. As use of the coupling cavities can simplify the waveguide network requirements, one skilled in the art will appreciate that higher operating frequencies are enabled by the present flat panel antenna, for example up to about 40 GHz, above which the required dimension resolution/feature precision may begin to make fabrication with acceptable tolerances cost prohibitive.

From the foregoing, it will be apparent that embodiments of the present invention provide a high performance flat panel antenna with reduced cross-section that is strong, lightweight and may be repeatedly cost efficiently manufactured with a very high level of precision.

Embodiments of the present invention have been described above with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element is referred to as being "on" another element, it can be directly on the other element or intervening elements may also be present. In contrast, when an element is referred to as being "directly on" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (i.e., "between" versus "directly between", "adjacent" versus "directly adjacent", etc.).

Relative terms such as "below" or "above" or "upper" or "lower" or "horizontal" or "vertical" may be used herein to describe a relationship of one element, layer or region to another element, layer or region as illustrated in the figures. It will be understood that these terms are intended to encompass different orientations of the device in addition to the orientation depicted in the figures.

Unless otherwise defined, all technical and scientific terms used herein have the same meaning as commonly understood by one of ordinary skill in the art to which this invention belongs. The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Aspects and elements of all of the embodiments disclosed above can be combined in any way and/or combination with aspects or elements of other embodiments to provide a plurality of additional embodiments.

In the drawings and specification, there have been disclosed typical embodiments of the invention and, although specific terms are employed, they are used in a generic and descriptive sense only and not for purposes of limitation, the scope of the invention being set forth in the following claims.

That which is claimed:

1. A panel array antenna, comprising:

an input layer comprising a waveguide network coupling an input feed on a first side thereof to a plurality of primary coupling cavities on a second side thereof; and an output layer on the second side of the input layer, the output layer comprising a monolithic layer including an array of horn radiators, respective horn radiator inlet ports in communication with the horn radiators, and respective slot-shaped output ports in communication with the respective horn radiator inlet ports to couple the horn radiators to the primary coupling cavities, wherein the horn radiators, the respective horn radiator inlet ports, and the respective slot-shaped output ports comprise respective orientations that are rotated relative to one another, wherein the respective horn radiator inlet ports are confined within edges of the horn radiators coupled thereto in plan view, and wherein the monolithic layer is configured to provide respective output signals from the horn radiators having a polarization orientation that is rotated by a desired polarization rotation angle relative to respective input signals received at the respective slot-shaped output ports coupled thereto.

2. The panel array antenna of claim 1, wherein the respective horn radiator inlet ports have respective longitudinal axes that are rotated relative to those of the respective slot-shaped output ports coupled thereto by the at least a portion of the desired polarization rotation angle.

3. The panel array antenna of claim 2, wherein the respective slot-shaped output ports comprise elliptical-shaped end portions coupled by an elongated slot extending therebetween along the respective longitudinal axes thereof.

4. The panel array antenna of claim 2, wherein each of the horn radiators comprises a plurality of sidewalls that extend from a base including a corresponding one of the respective horn radiator inlet ports coupled thereto, and wherein the plurality of sidewalls define a hexagonal shape around the corresponding one of the respective horn radiator inlet ports.

5. The panel array antenna of claim 2, wherein the monolithic layer further comprises respective polarization rotator elements in communication with the respective horn radiator inlet ports to couple the horn radiators to the respective slot-shaped output ports, the respective polarization rotator elements having respective longitudinal axes that are rotated relative to those of the respective horn radiator inlet ports coupled thereto.

6. The panel array antenna of claim 5, wherein the respective polarization rotator elements are confined within edges of the respective horn radiator inlet ports coupled thereto in plan view.

7. The panel array antenna of claim 6, wherein the respective polarization rotator elements comprise respective multi-sided openings having one or more edges that are aligned with one or more of the edges of the respective horn radiator inlet ports coupled thereto in plan view.

8. The panel array antenna of claim 7, wherein the respective multi-sided openings are confined within edges of and/or have respective longitudinal axes rotated relative to those of the respective slot-shaped output ports coupled thereto.

9. The panel array antenna of claim 8, wherein the respective longitudinal axes of the respective multi-sided openings are rotated relative to those of the respective slot-shaped output ports and/or the respective horn radiator inlet ports coupled thereto by a portion of a desired polarization rotation angle.

10. The panel array antenna of claim 2, wherein each of the horn radiators comprises a plurality of sidewalls that uniformly extend around a perimeter thereof from a base including one of the respective horn radiator inlet ports therein.

11. The panel array antenna of claim 1, wherein the respective slot-shaped output ports, the respective horn radiator inlet ports, and/or the horn radiators comprise radiused ends.

12. The panel array antenna of claim 11, wherein the monolithic layer comprises the horn radiators, the respective horn radiator inlet ports, and the respective slot-shaped output ports machined therein.

13. A panel array antenna, comprising:

an input layer comprising a waveguide network coupling an input feed on a first side thereof to a plurality of primary coupling cavities on a second side thereof; and an output layer on the second side of the input layer, the output layer comprising an array of horn radiators, a plurality of elongated ports in communication with the horn radiators and coupled to each of the primary coupling cavities by respective elongated slots between the elongated ports and each of the primary coupling cavities, wherein the elongated ports and the respective elongated slots coupled thereto comprise respective longitudinal axes having different orientations, and the horn radiators, the elongated ports, and the respective elongated slots are integrated in a monolithic layer that is configured to rotate a polarization orientation of respective input signals received at the respective elongated slots, and wherein the elongated ports are confined within edges of the horn radiators in communication therewith in plan view.

14. The panel array antenna of claim 13, wherein the respective elongated slots comprise elliptical-shaped end portions along the respective longitudinal axes that are rotated relative to those of the elongated ports coupled thereto.

15. The panel array antenna of claim 13, further comprising:

respective diamond-shaped slots coupled between the elongated ports and the respective elongated slots coupled thereto, wherein the respective diamond-shaped slots comprise one or more edges that are aligned with the edges of the elongated ports coupled thereto in plan view.

16. The panel array antenna of claim 13, wherein the elongated ports comprise horn radiator inlet ports, and wherein the array of horn radiators are integrated in the monolithic layer on a second side thereof opposite the second side of the input layer, wherein each of the horn radiators is coupled to one of the respective elongated slots by one of the horn radiator inlet ports at a base thereof, wherein the respective longitudinal axes of the horn radiator inlet ports are rotated relative to those of the respective elongated slots coupled thereto by at least a portion of a desired polarization rotation angle.

17. A method of manufacturing a panel array antenna, the method comprising:

providing an input layer comprising a waveguide network coupling an input feed on a first side thereof to a plurality of primary coupling cavities on a second side thereof; and providing an output layer on the second side of the input layer, the output layer comprising a monolithic layer including an array of horn radiators, respective horn radiator inlet ports in communication with the horn radiators, and slot-shaped output ports in communication with the respective horn radiator inlet ports to couple the horn radiators to the primary coupling cavities, wherein the respective horn radiator inlet ports are formed by machining from a second side of the output layer through openings defined by the horn radiators therein such that the respective horn radiator inlet ports are confined within edges of the horn radiators coupled thereto in plan view, and wherein the monolithic layer is configured to provide respective output signals from the horn radiators having a polarization orientation that is rotated by a desired polarization rotation angle relative to respective input signals received at the respective slot-shaped output ports coupled thereto.

18. The method of claim 17, wherein providing the output layer comprises:

forming the horn radiators, the respective horn radiator inlet ports, and the respective slot-shaped output ports coupled thereto in the monolithic layer to define respective orientations that are rotated relative to one another by at least a portion of the desired polarization rotation angle.

19. The method of claim 18, wherein:

forming the respective slot-shaped output ports comprises forming elliptical-shaped end portions coupled by an elongated slot extending therebetween along the respective longitudinal axes thereof; and forming the respective horn radiator inlet ports defines respective longitudinal axes that are rotated relative to those of the respective slot-shaped output ports coupled thereto by the at least a portion of the desired polarization rotation angle.

20. The method of claim 18, wherein providing the output layer comprises:

forming respective multi-sided openings in the output layer to define respective polarization rotator elements therein, the respective multi-sided openings having respective longitudinal axes that are rotated relative to those of the respective horn radiator inlet ports coupled thereto.

21. The method of claim 20, wherein the respective longitudinal axes of the respective multi-sided openings are rotated relative to those of the respective slot-shaped output ports coupled thereto, wherein the forming of the respective multi-sided openings comprises machining the respective multi-sided openings in the output layer, wherein the machining is performed from the second side of the output layer through openings defined by the horn radiators and the respective ports therein, and/or is performed from a first side of the output layer opposite the second side through openings defined by the respective slot-shaped output ports.

22. A method of manufacturing a panel array antenna, the method comprising:

providing an input layer comprising a waveguide network coupling an input feed on a first side thereof to a plurality of primary coupling cavities on a second side thereof; and providing an output layer on the second side of the input layer, wherein providing the output layer comprises forming, in a monolithic layer, an array of horn radiators, respective horn radiator inlet ports in communication with the horn radiators, and slot-shaped output ports in communication with the respective horn radiator inlet ports to couple the horn radiators to the primary coupling cavities, wherein the monolithic layer is configured to provide respective output signals from the horn radiators having a polarization orientation that is rotated by a desired polarization rotation angle relative to respective input signals received at the respective slot-shaped output ports coupled thereto, wherein the horn radiators, the respective horn radiator inlet ports, and the respective slot-shaped output ports comprise respective orientations that are rotated relative to one another by at least a portion of the desired polarization rotation angle, and wherein providing the output layer further comprises machining respective multi-sided openings in the output layer to define respective polarization rotator elements therein, the respective multi-sided openings having respective longitudinal axes that are rotated relative to those of the respective horn radiator inlet ports coupled thereto, wherein the machining is performed from a second side of the output layer through openings defined by the horn radiators and the respective ports therein such that the respective multi-sided openings are confined within edges of the respective ports coupled thereto in plan view.

23. A panel array antenna, comprising:

an input layer comprising a plurality of primary coupling cavities on a first side thereof; and an output layer on the first side of the input layer, the output layer comprising a monolithic layer having an array of radiators and respective elongated slots in communication with the radiators integrated therein, wherein the respective elongated slots couple the radiators to the primary coupling cavities, wherein the respective elongated slots comprise respective longitudinal axes that are non-parallel to respective longitudinal axes of the primary coupling cavities, and are confined within edges of the radiators in communication therewith in plan view.

24. The panel array antenna of claim 23, wherein a plurality of the radiators is coupled to each of the primary coupling cavities by the respective elongated slots.

25. The panel array antenna of claim 23, wherein the respective longitudinal axes of the respective elongated slots are rotated relative to the respective longitudinal axes of the primary coupling cavities by a portion of a desired polarization rotation angle.

26. A panel array antenna, comprising:

an output layer comprising a monolithic layer having an array of radiators and respective elongated slots in communication with the radiators integrated therein, wherein the respective elongated slots are configured to couple the radiators to primary coupling cavities of an input layer of the panel array antenna, wherein the radiators are arranged in rows along a first direction, and wherein the respective elongated slots comprise respective longitudinal axes that are rotated by respective non-zero angles relative to the first direction, and are confined within edges of the radiators in communication therewith in plan view.

27. The panel array antenna of claim 26, wherein a plurality of the radiators is coupled to each of the primary coupling cavities by the respective elongated slots.

28. The panel array antenna of claim 26, wherein the respective longitudinal axes of the respective elongated slots are rotated relative to respective longitudinal axes of the primary coupling cavities by a portion of a desired polarization rotation angle.

* * * * *